US012612720B1

(12) United States Patent
King et al.

(10) Patent No.: US 12,612,720 B1
(45) Date of Patent: Apr. 28, 2026

(54) APPARATUS, METHOD AND COMPUTER PROGRAM PRODUCT FOR PROVIDING PRESSURE SENSITIVE PADS IN TEXTILES AND FLEXIBLE MATERIALS

(71) Applicant: Applied Sensor Co., LLC, Woodinville, WA (US)

(72) Inventors: Raymond John King, Woodinville, WA (US); Christopher Francis Anderson, Tukwila, WA (US)

(73) Assignee: Applied Sensor Co., LLC, Woodinville, WA (US)

( * ) Notice: Subject to any disclaimer, the term of this patent is extended or adjusted under 35 U.S.C. 154(b) by 148 days.

(21) Appl. No.: 18/632,874

(22) Filed: Apr. 11, 2024

Related U.S. Application Data

(60) Provisional application No. 63/459,397, filed on Apr. 14, 2023.

(51) Int. Cl.
*D04B 39/00* (2006.01)

(52) U.S. Cl.
CPC ..... *D04B 39/00* (2013.01); *D10B 2401/18* (2013.01)

(58) Field of Classification Search
CPC ..... D04B 39/00; D10B 2401/18
USPC ..... 340/500
See application file for complete search history.

(56) References Cited

U.S. PATENT DOCUMENTS

| | | | | |
|---|---|---|---|---|
| 6,210,771 | B1 * | 4/2001 | Post | H05K 1/038 361/212 |
| 9,671,297 | B2 * | 6/2017 | Sibbett | G06F 3/045 |
| 2020/0160233 | A1 * | 5/2020 | Chopra | G06Q 30/0207 |
| 2020/0281496 | A1 * | 9/2020 | Obi | A61B 5/0245 |
| 2021/0038006 | A1 * | 2/2021 | Abdulrahman | H04W 4/023 |
| 2022/0117426 | A1 * | 4/2022 | Soleimani | B32B 5/18 |
| 2022/0202112 | A1 * | 6/2022 | Seyed | A41D 1/005 |

* cited by examiner

*Primary Examiner* — Kerri L Mcnally
(74) *Attorney, Agent, or Firm* — Reston Law Group, LLP; Ralph P. Albrecht

(57) ABSTRACT

A pressure sensing textile may include, in one embodiment, a first layer of comprising fabric, said first layer comprising fabric being embroidered with a first at least one conductive threads, a second layer comprising a pressure sensitive conductive sheet, and a third layer comprising fabric, said third layer comprising fabric being embroidered with a second at least conductive thread. Embodiments of the invention relate to construction of a pressure sensitive textile that can be used to collect data on the interaction with a dynamic load. An exemplary application is in the construction of wearable clothing for sensing mechanical stress experienced as pressure on a human body. Another exemplary application is the use of pressure sensitive pads embedded in a carpeted floor surface for collecting foot traffic data. Another exemplary application is use in an inventory control system. The present invention is not limited to these examples and can be applied to measure and track a wide range of dynamic loads affected by animals, humans, equipment, or the like, embedded in or applied to any accommodating surface material, fabrics, plastics, elastomers, or the like.

17 Claims, 30 Drawing Sheets

500

FIG 6 is a system level view of invention in a floor tile embodiment connecting to a computer system.

Battery and board inside and connectis wire/wireless.

Laptop visualization.

Both are outside – alarm system

Board inside, battery outside, another wire/fiber/wireless

FIG 7 is a system level view of invention in a floor tile embodiment connecting to a computer system.

Both are outside – alarm system

FIG 8 is a system level view of invention in a floor tile embodiment connecting to a computer system.

FIG 9 is a system level view of invention in a floor tile embodiment connecting to a computer system.

FIG 10 is a diagram showing the three layers of the pressure sensing textile element invention;

FIG 11 is a diagram showing the three layers of the pressure sensing textile element invention;

FIG 12 is a detailed view of the first or third layer of FIG. 1 showing the detailed connection of the microprocessor to the pressure sensing textile elements;

1300

FIG 13 may have a plurality of pressure sensing textile elements (100) configured in a grid pattern which may be electrically connected together in rows and columns such that multiple pressure sensing elements (100) may be measured simultaneously by an electrically connected processor system (204).

1400

Example Processing Flow Diagram

Example two Pad system

1700

1800

1900

2000

2100

2200

2300

2400

2500

2600

2700

2800

2900

3000

APPARATUS, METHOD AND COMPUTER PROGRAM PRODUCT FOR PROVIDING PRESSURE SENSITIVE PADS IN TEXTILES AND FLEXIBLE MATERIALS

CROSS-REFERENCE TO RELATED APPLICATION

This application is a U.S. NonProvisional Patent Application claiming the benefit under 35 USC Section 119(e) of U.S. Patent Application Ser. No. 63/459,397, ('397 Application) filed on Apr. 14, 2023, having confirmation no. 1656, the contents of which is incorporated herein by reference in its entirety.

BACKGROUND OF THE DISCLOSURE

Technical Field of the Disclosure

The present invention relates generally to materials and more particularly to the construction of materials.

Related Art

Conventional computing systems include traditional hard, rigid interaction devices like cell phones, keyboards, controllers, and remotes. Unfortunately, conventional solutions for constructing materials have various shortcomings.

Various conventional systems include: U.S. Pat. No. 8,966,997B2—Pressure sensing mat; U.S. Pat. No. 9,733,136B2—Textile pressure sensor; US20220252472A1—Embroidered sensor; U.S. Pat. No. 9,816,799B2—Embroidered strain sensing elements; U.S. Pat. No. 9,129,513B1—Floor mat system; U.S. Pat. No. 6,543,299B2—Pressure measurement sensor with piezoresistive thread lattice; U.S. Pat. No. 8,800,386B2—Fore sensing sheet; U.S. Pat. No. 8,161,826B1—Elastically stretchable fabric force sensor arrays and methods of making; U.S. Pat. No. 8,661,915B2—Elastically stretchable fabric force sensor arrays and methods of making; U.S. Pat. No. 9,442,614B2—Two-dimensional sensor arrays; U.S. Pat. No. 7,770,473B2—Pressure sensor; U.S. Pat. No. 6,216,545B1—Piezoresistive foot pressure measurement; U.S. Pat. No. 8,701,578B2—Digital garment using embroidery technology and fabricating method thereof; US20160048235A1—Interactive Textiles; US20160328043A1—Embroidered Touch Sensors; U.S. Pat. No. 8,904,876B2—Flexible piezo capacitive and piezo resistive force and pressure sensors; U.S. Pat. No. 5,079,949A—Surface pressure distribution detecting element; DE202015004254U1—Pressure-sensitive textile sensor surface; DE102018128082A1—Pressure sensor device for an assembly glove, assembly glove with a pressure sensor device and method for producing a pressure sensor device for an assembly glove; US20180266900A1—Pressure Sensor; US20140150573A1—Device for Measuring Pressure from a Flexible, Pliable, and/or extensible Object Made from a Textile Material comprising a Measurement Device; US20150038881A1—Posture Monitoring System; U.S. Pat. No. 8,966,997B2—Pressure Sensing Mat; U.S. Pat. No. 9,032,804B2—A large-area extensible pressure sensor for textiles surfaces; US20150331512A1—Promoting sensor isolation and performance in flexible sensor arrays; US20150331524A1—Two-dimensional sensor arrays; U.S. Pat. No. 9,271,665B2—Fabric-based pressure sensor arrays and methods for data analysis; US20130085394A1—Glove with integrated sensor; U.S. Pat. No. 9,301,563B2—Pressure sensing glove; US20180299991A1—Interactive skin for wearable; U.S. Pat. No. 10,698,532B2—A stretchable touchpad of the capacitive type the contents of all of the preceding, are incorporated herein by reference, in their entireties. The following disclosure discloses useful, new and nonobvious improvements to various apparatuses, methods, systems, and computer program products to address aforementioned issues and to overcome shortcomings of these and other conventional solutions.

SUMMARY OF THE INVENTION

Overview

Embodiments of the present invention feature a new and improved apparatus, systems, method of construction, and a computer program product to create a flexible pressure sensing textile constructed of three layers using commercially available materials. In one exemplary embodiment, an industrial embroidery machine may be used to form sensor pads of conductive thread on the two inner surfaces of fabric that sandwich a third layer of carbon impregnated conductive foam. In addition to aligning and stitching the three layers together, the embroidery machine may use a variety of embroidery techniques to construct electrical components, form electric connections to components, create electrical circuits, form non-conductive conduits and connect directly to an electronic module. This construction technique may allow complex designs of different pressure pad layout, size, sensitivity, dynamic range and mechanical flexibility to be easily created for a range of applications, scaled to large volumes and cost effectively mass produced. It should be recognized that the use of an industrial embroidery machine is not the only method by which the invention may be produced and its use herein is given as an example which in no way limits the use of other methods of construction, according to other example embodiments.

The present disclosure sets forth various exemplary embodiments illustrating example apparatus, systems, methods and computer program product for providing pressure sensing in flexible materials, according to other example embodiments.

According to some embodiments, a pressure sensing textile element may include a first textile layer, a second conductive sheet layer, and a third textile layer, according to an example embodiment. The first layer may include a non-conductive textile layer with conductive thread stitching that forms an electrically conductive trace that connects to a conductive thread stitched pad, this may be the underside of the first layer, according to an example embodiment. The second layer may include a conductive sheet across which conductivity may change with applied pressure, according to an example embodiment. The third layer may include a non-conductive textile layer with conductive thread stitching that may form an electrically conductive trace that may connect or couple to a conductive thread stitched pad on the topside of the third layer, according to an example embodiment. The first layer may be positioned to align with said second conductive thread of said third layer to electrically connect or couple the three layers and may create a pressure sensitive area across the second layer at one or more locations where the two pressure sensitive pads may align, according to an example embodiment.

In some embodiments, a single pressure sensing textile element may cover the entire surface of a textile surface, according to an example embodiment. In some embodiments an electrical signal or voltage may be applied to the said first layer conductive thread trace and an electronic circuit operable to monitor said electrical signal or voltage may be coupled or connected to said third layer conductive thread trace, according to an example embodiment. In an exemplary embodiment, a mat, carpet tile, rug, carpet, or the like with a pressuring sensing element may operate in conjunction with said electronic circuit to affect a threshold sensing mode where pressure above a pre-specified threshold or any other definable and measurable event may generate an "on/off" signal to an external exemplary electronic system that may control lights, alarms, chimes, or any number devices including but not limited to "Internet of Things" (IoT) devices, according to an example embodiment. An additional top and bottom protective layer may be added to the pressure sensing textile to protect either or both layers from environmental and wear damage and may provide traction with the floor below and foot traffic above, according to an example embodiment. A hard shell may be stitched onto the textile to cover and may protect the electronic circuit, according to an example embodiment.

In some embodiments, an exemplary system may include a multitude of pressure sensing elements, which may in one embodiment be laid out in a grid pattern across a textile surface, according to an example embodiment. Pressure sensing areas may be connected or coupled electrically using conductive thread to be configured as "rows" on one of the first or third layers, and "columns" on the other of the first and third layers, according to an example embodiment. In this embodiment, the grid of pressure sensing textile elements may enable the measurement of both pressure and location to be determined and/or recorded across the textile surface with a resolution, which may be constrained by the grid spacing of the pressure sensitive areas, according to an example embodiment. Those skilled in the art will recognize that physical layout of the pressure sensing elements may not necessarily conform to a rigid grid pattern or be orientated in any particular direction with respect to each other and that an example purpose of connecting or coupling the pressure sensitive pads together on the first and third layers may be to allow simultaneous reading of multiple sensing elements by an exemplary electronic control module, according to an example embodiment. An exemplary electronic control module may contain a processor system or other electronic circuitry and/or may include one or more of Analog to Digital (A2D) converters, according to an example embodiment. An exemplary electronic control module may be embedded in the textile by stitching and may be connected or coupled to other control modules within the textile or within other textiles by wiring, coupling, connecting, or other ways, according to an example embodiment.

In an exemplary embodiment, power may be provided to an electronic control module by, e.g., but not limited to, a battery, power storage system, etc., stitched into the textile or power may be provided to the textile by, e.g., but not limited to, an external power source, etc., through external wiring, according to an example embodiment. Measurement data may be collected by an electronic control module, according to one example embodiment, from the sensing elements by example row and/or by column using, e.g., but not limited to, a standard electronics multiplexing technique, etc., whereby an electrical signal or voltage may be applied to each example row (or column) in turn and at each turn measurement data may be simultaneously read any, and/or from all sensors in each column (or row) in sequence, according to an example embodiment. Measurement data may be processed and may be stored in the electronic control module and may be sent over a wired, optical or wireless connection to an external computer system wherein it may be, e.g., but not limited to, stored, analyzed and/or visualized, etc., according to an example embodiment. Such an exemplary system may be embedded in carpets and/or may be used to, e.g., but not limited to, record activity, weights, size measures, etc., for foot-traffic monitoring, and/or for inventory management, and other uses, etc., according to an example embodiment.

In some exemplary embodiments, such as, e.g., but not limited to, in a glove or other wearable textile and/or integrated prostheses, and/or other subsystem capable of interface and/or coupling via embedded, implantation, and/or side-by-side coupling, a plurality of pressure sensing pressure sensing elements may be sparsely laid out across a soft textile surface and placed in locations key to a specific application, according to an example embodiment. Some embodiments may be configured such that pressure sensors physically distributed across the textile are electrically connected or coupled in a grid or pseudo-grid arrangement that minimizes the number of connections to an electronic control module, according to an example embodiment. In some embodiments of a wearable textile, pressure sensing textile elements may be constructed wherein the first layer may be the outer layer of clothing and the third layer may be an inner layer of clothing, according to an example embodiment. In such exemplary embodiments, variations in pressure sensing textile elements size and density may enable clothing with an embedded number-pad or generic touch pad, or pressure sensitive areas in socks, shirts, pants, gloves, prosthetic sockets, or the likes, according to an example embodiment.

It may be understood that the invention may not be limited to the exemplary embodiments as described, according to an example embodiment. The conductive thread stitching of traces and pads on the first and third layers may include any flexible conductive element that can be attached and automated on an industrial embroidery machine including, e.g., but not limited to, thin conductive wires, conductive sprays, conductive ink, or the like, etc., according to an example embodiment. The example shape and size of the conductive thread stitching traces and pads may be only limited by the example accuracy and/or repeatability of example industrial manufacturing machines, according to an example embodiment. According to an example embodiment, an example high end embroidery machines, such as, e.g., but not limited to, those produced by ZSK Stickmaschinen in Germany, are capable of precisely laying down stitching, embroidery, and a multitude of conductive wires, conductive sprays, conductive ink, or the like, according to an example embodiment. The second layer conductive sheet may be replaced, e.g., but not limited to, by, e.g., a piezoelectric sheet, conductive foam, dielectric sheet, or the like, that can be pierced by an industrial embroidery machine and are sensitive to pressure changes, according to an example embodiment. The first and third textile layers may be replaced, according to other example embodiments, by non-conductive flexible material that can be pierced by an industrial embroidery machine, such as, but not limited to, textile, plastics, or elastomers, etc., according to an example embodiment.

The simple and low-cost construction method, according to this illustrative embodiment, of using industrial manufacturing embroidery machines to realize the current embodiments of the claimed invention enables a significant drop in complexity and production cost compared to previous generations of conventional textile pressure sensing systems, according to an example embodiment.

DETAILED DESCRIPTION OF VARIOUS EXAMPLE EMBODIMENTS

Overview of Example Embodiments

Figure 1:
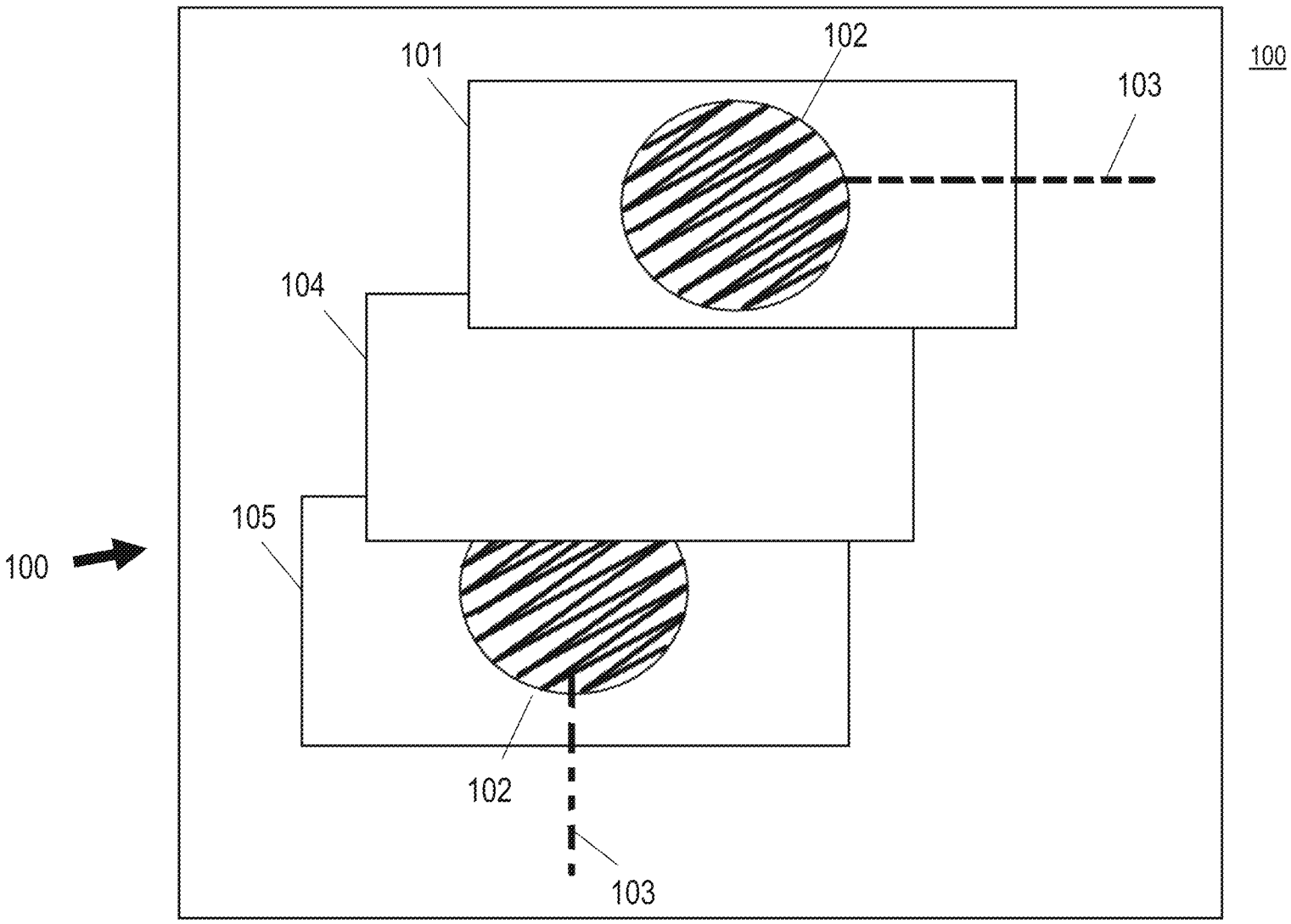
FIG. 1 depicts an example illustration of an example embodiment, which may include a diagram showing the three layers of the pressure sensing textile element invention, according to an example embodiment.

As technology continues to evolve so does the way people interact with technology. Over the next few decades, technology will move away from traditional hard, rigid interaction devices like cell phones, keyboards, controllers, and remotes and migrate towards soft, flexible interaction devices. These devices will be seamlessly integrated into everyday clothing and other surfaces. This transformation has already begun with an array of available smart wearables and surfaces, however complex material development and the high cost of manufacturing limits the widescale adoption and mass-market potential of many of these devices.

The integration of electronics into fabrics offers a new range of electrical and mechanical materials possibilities. Fabrics and other flexible substrates allow for materials that can cover other surfaces functionalizing existing rigid materials. Fabrics and flexible substrates have different mechanical properties such as bending, decreased fatigue, and variable electrical response.

Wider adoption of these materials may be dependent on simple, scalable, cost-effective methods for constructing interaction surfaces and integrating these into soft fabrics or bonding to more rigid substrates without compromising performance or durability. The present invention uses conductive thread and embroidery techniques to create a pressure sensitive touch pad interaction surface that can be incorporated into a variety of flexible materials, including textiles, plastics and elastomers, with a low piece cost and highly scalable manufacturing process.

There is conventional work in the area of creating resistive based pressure sensitive pads in flexible materials consisting generally of one layer, two layer, and three-layer approaches, but improvements as set forth herein are needed.

U.S. Pat. No. 9,816,799B2, the contents of which is incorporated herein by reference in its entirety, is a single layer approach that teaches how to create a textile strain sensor from conductive threads in different configurations. The deformation of the textile backing layer creates measurable changes in the conductive thread resistance due to its meandering shape and configuration relative to the textile deformation. This conventional system relies on a multi thread only system that takes extra production time and does not account for elasticity of the fabric carrier.

US Patent US20220252472A1, the contents of which is incorporated herein by reference in its entirety, describes another single layer approach that uses conductive thread to form pressure sensitive regions in a textile, whereby a textile sensor can be made by measuring the change in resistance across two parallel conductive threads when a third conductive thread is pressed down as a bridge between them. This conventional system does not solve manufacturability and cost issues. Improved system are needed including using a system that is solely comprised of custom threads for both the resistive elements and conductive elements.

U.S. Pat. No. 10,945,663B2, the contents of which is incorporated herein by reference in its entirety, describes a system of sensing grinds made by orthogonally oriented fibers that are extruded to have specified shapes in the cross direction of the fibers. These fibers allow for moisture and pressure sensing due to the resistive deformation within the fiber. However, this conventional system relies on the creation of customized fiber diameters which limits economy of the solution until large volumes are realized.

A two layer approach described by U.S. Pat. No. 6,543,299B2, the contents of which is incorporated herein by reference in its entirety, teaches how to create a pressure sensitive array using a piezoresistive thread lattice. This method uses threads consisting of a wire core covered in a pressure sensitive piezoresistive material with one layer of horizontally arranged parallel threads and one layer of vertically arranged parallel threads, whereby each intersection of horizontal and vertical threads is an individual force sensing element. The production of these piezoresistive spiral wrapped threads is not the most economic realization. Improved systems as set forth herein are needed.

A three layer approach is the most common approach used to creating pressure sensitive pads. The related art of conventional systems as set forth in U.S. Pat. Nos. 9,442,614B2, 8,661,915B2, and 8,161,826B1, the contents of all of which are incorporated herein by reference in their entireties, and others referenced below, teach how to create a pressure sensing fabric using two layers of material constructed with elastically stretchable and orthogonally arranged conductive traces separated by a third layer of stretchable piezoresistive material. Each junction point between the two layers of orthogonally arrange conductive traces is an individual force sensing element. Examples of variations on this method can be found in U.S. Pat. Nos. 8,800,386B2 and 8,966,997B2, the contents of all of which are incorporated herein by reference in their entireties. In U.S. Pat. No. 8,800,386B2, the contents of which is incorporated herein by reference in its entirety, the addition of a semiconductive material creates P-N junction that reduces cross talk between individual sensing elements. In U.S. Pat. No. 8,966,997B2, the contents of which is incorporated herein by reference in its entirety, a piezoelectric crystal particle bath is used to create a custom stretchable piezoresistive material. Alternatively, in U.S. Pat. No. 9,733,136B2, the contents of which is incorporated herein by reference in its entirety, a capacitive force sensing sheet is shown where the orthogonally arranged conductive traces are knitted by a knitting machine and a knitted dielectric layer is placed in between the two conductive layers. None of these conventional solutions set forth an improved system as disclosed herein, which provides the most efficient way of making a sensor grid for economic mass production.

Alternative three layer conventional approaches are also discussed in International Patent Publication WO2021163678A1, claiming priority from US Patent Application U.S. 62/977,132, the contents of which is incorporated herein by reference in its entirety. In this patent application, a three layer system grid is built on capacitive touch sensing approach. Capacitive touch sensing has the ability to detect based on the capacitance change due to the difference in distance between two conductive areas. This conventional system lacks the ability to receive pressure-based data.

System integration is another key aspect of receiving data. Conventional systems including International Patent Publication WO2023283011A1, claiming priority to and corresponding to US Patent Application Publication US20230010248A1, the contents of which is incorporated herein by reference in its entirety, describes a system of using a fabric to authenticate a person to a computer system. This conventional system is used to authenticate a user when that specific label comes in contact with the textile.

A pressure sensitive pad to be placed under a mattress is detailed in International Patent Publication WO2023275824A1, corresponding to U.S. Pat. No. 11,513,020B1, the contents of which is incorporated herein by reference in its entirety. This conventional system creates a pad that is placed under a mattress to take pressure readings from the mattress. This invention does not detail the method of manufacture and only notes that the pad is placed under a mattress to identify a weight. Improved solutions as set forth herein are needed.

A pressure sensitive cushion that includes air bladders and stretchable conducive sheet is detailed in U.S. Pat. No. 9,642,470B2, the contents of which is incorporated herein by reference in its entirety. This conventional system details the use of stitching the conductive thread in a zigzag pattern to create regions of conductivity. This conventional patent requires an air cushion in conjunction with a pressure sensitive region. This conventional multilayer system includes an air cushion layer. Improved systems are needed.

FIG. 1 illustrates the construction of the pressure sensing textile element (100), according to an example embodiment. In this representative, illustrative, but non-limiting, embodiment all stitching may be accomplished using an industrial embroidery machine that both creates the conductive elements and stitches all the layers together, according to an example embodiment. The first non-conductive textile layer (101) has conductive thread stitching traces (103) leading to the circular conductive thread stitched pad (102) on the inner surface of the first layer, according to an example embodiment. The first layer may be attached to the second layer, the pressure sensitive conductive sheet (104), using non-conductive thread, although this construction step may be accomplished using adhesives, heat press, or other method to bond the layers together, according to an example embodiment. The third non-conductive textile layer (105) has conductive thread stitching traces (103) leading to the circular conductive thread stitched pad (102), according to an example embodiment. The third layer may be attached to the first and second layers through stitching or previously described alternative bonding method, according to an example embodiment. The three layers may be stitched or bonded together as two separate steps or in a single process, according to an example embodiment.

From FIG. 1, the pressure sensitive conductive sheet (102) may be Velostat/Lingstat, a commercially available polymeric foil impregnated with carbon that makes it electrically conductive, according to an example embodiment. Thin sheets of Velostat may be obtained inexpensively and may be both easy to cut into a desired size and shape and soft enough to be easily pierced by an industrial embroidery machine, according to an example embodiment. Different thicknesses and grades of Velostat may be used to alter the sensitivity, measurable range, thickness, flexibility and softness of the finished textile, according to an example embodiment. Velostat may be an example material, and any conductive, soft pressure sensitive material may be used, including, but not limited to, piezoelectric materials, carbon impregnated silicones, fabrics, or foams, according to an example embodiment.

From FIG. 1, the conductive thread stitching traces (103) and pads (102) can be made of a number of commercially available conductive threads and yarns, such as Madeira HC40—a silver-plated polyamide thread, according to an example embodiment. Conductive threads are typically a blend of non-conductive fibers and metal that maintain their textile like properties and function like any other thread in industrial embroidery machinery, according to an example embodiment. Madeira HC40 may be an example thread, and any conductive thread or thin wire may be used, including, but not limited to, carbon fibers, electrically coated threads and yarns, according to an example embodiment. Wires may be of stainless steel, copper, aluminum or other metals and which may be plated with gold, silver or other conductive coating, according to an example embodiment.

In some exemplary embodiments of FIG. 1, the first and third layers are made of two different non-conductive materials, according to an example embodiment. One such exemplary embodiment may be a floor tile, where the first layer (101) may be a non-conductive fabric such as carpet and the third layer (105) may be a stiffer non-conductive backing material, according to an example embodiment. This embodiment may use conductive thread stitching (103) on both the first layer (101) and third layer (105), or if the third layer may be too hard for an industrial embroidery machine to stitch a conductive spray, ink, or wire could be used to replace the conductive thread stitched traces (103) and pads (102), according to an example embodiment. In another exemplary embodiment the first layer (101) may be a non-conductive hard wearing clothing material and the third layer (105) may be a very soft non-conductive material that was more breathable and comfortable as wearable clothing in contact with the human body, according to an example embodiment.

Figure 1A:
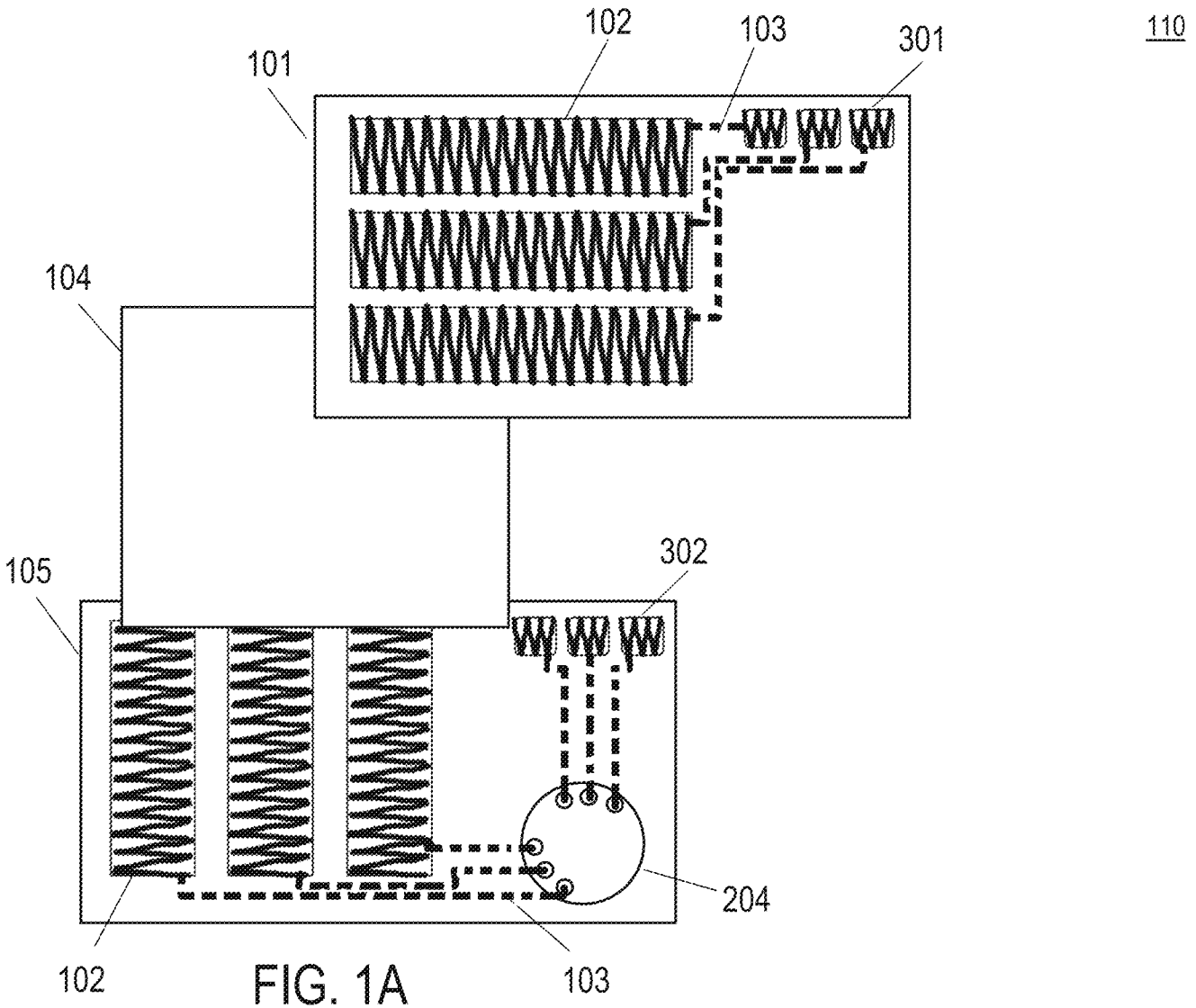
FIG. 1A depicts an example illustration of an example embodiment, which may include a diagram showing an exemplary embodiment grid pattern which may be electrically connected or coupled together in rows and columns such that a plurality of pressure sensing elements may be measured simultaneously by an electrically connected or coupled processor system, according to an example embodiment.
Figure 1B:
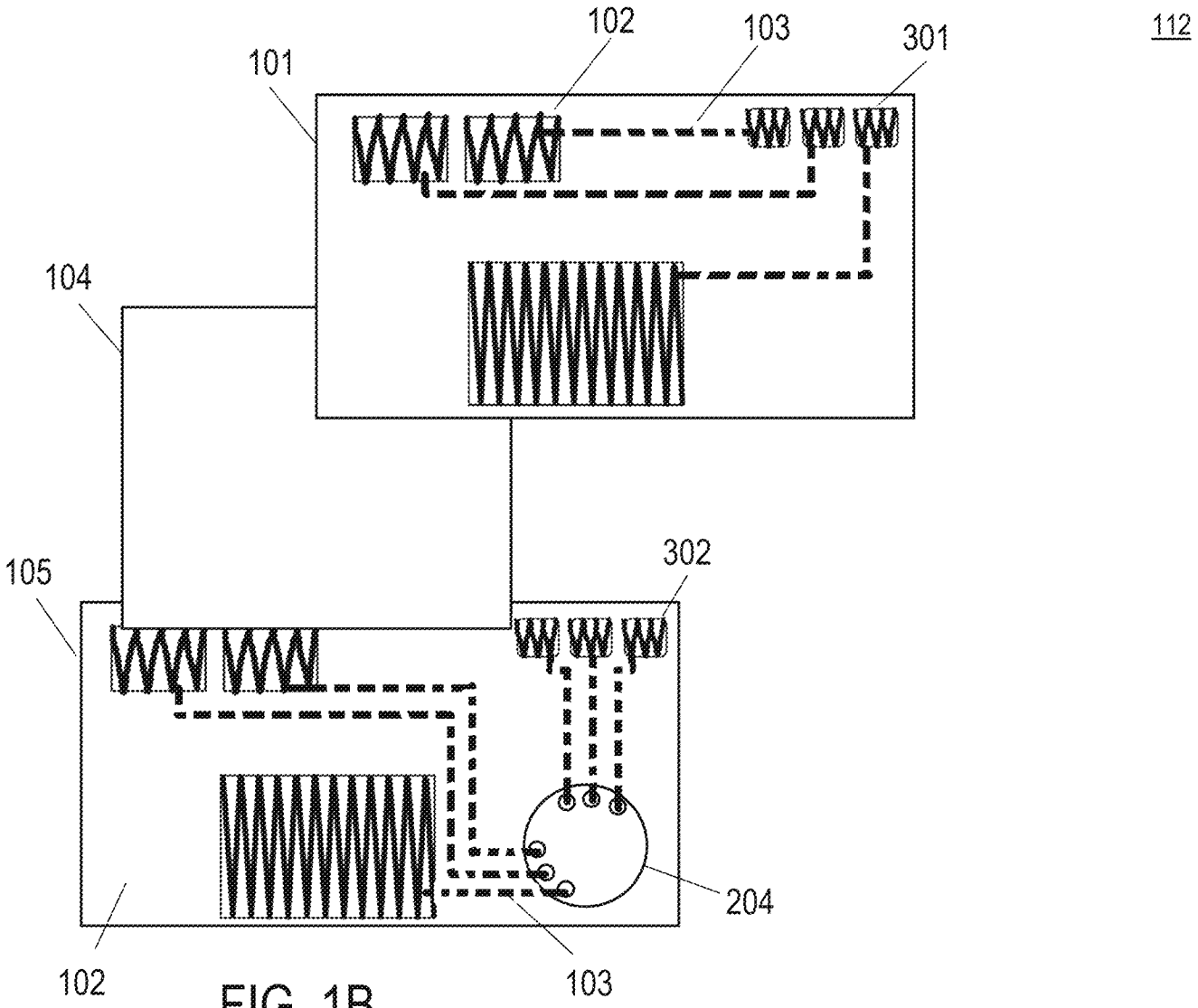
FIG. 1B depicts an example illustration of an example embodiment, which may include a diagram showing a plurality of pressure sensing textile elements of different shapes and sizes.

In some exemplary embodiments of FIG. 1 a single pressure sensing textile element (100) may cover the entire surface of the textile and may be electronically connected or coupled to external sensing equipment such as a counter, or the contacts of an alarm input. Other exemplary embodiments (FIG. 1A) may have a plurality of pressure sensing textile elements (100) configured in a grid pattern which may be electrically connected or coupled together in rows and columns such that multiple pressure sensing elements (100) may be measured simultaneously by an electrically connected or coupled processor system (204), according to an example embodiment. A further exemplary embodiment (FIG. 1B) may have a plurality of pressure sensing textile elements (100) of different shapes and sizes constructed in a regular grid pattern or placed individually in an irregular arrangement, according to an example embodiment.

Figure 1C:
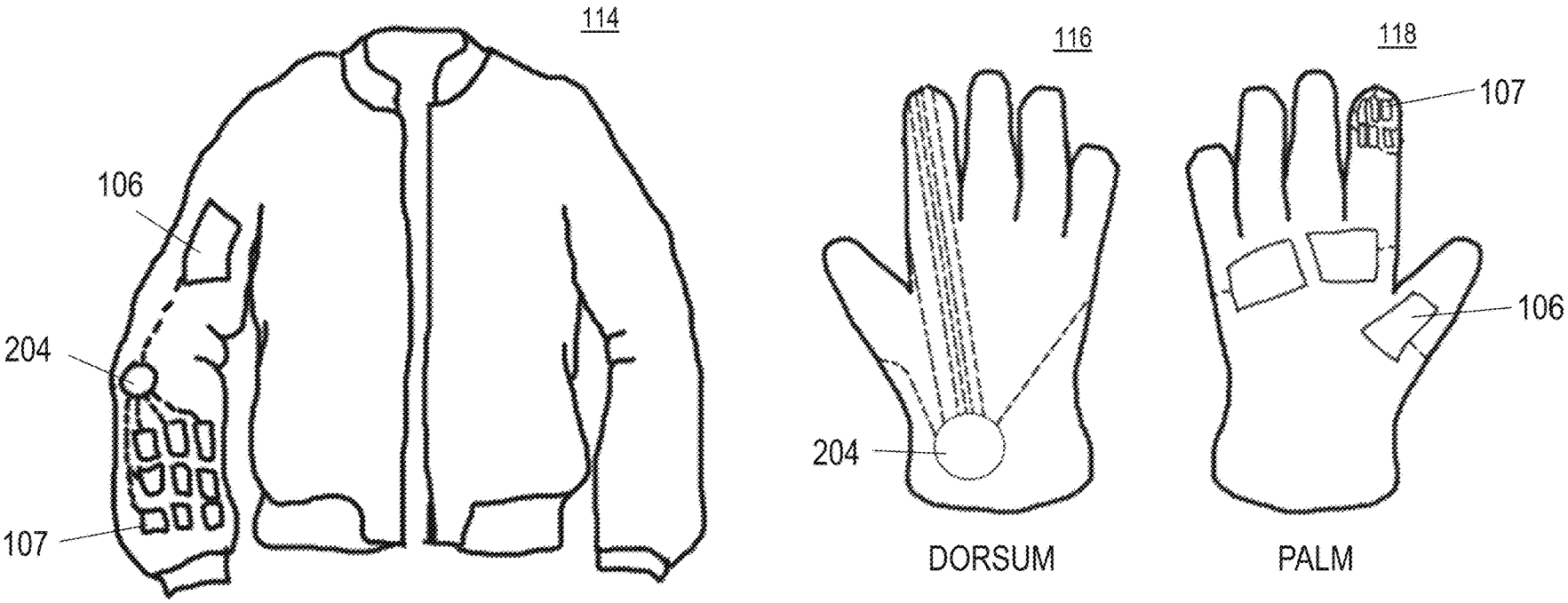
FIG. 1C depicts an example illustration of an example embodiment, which may include a diagram showing two exemplary embodiments for applying the pressure sensing textile element in different shapes and sizes for a jacket and glove system, according to an example embodiment.

Exemplary wearable embodiments are shown in FIG. 1C, according to an example embodiment. Wearable embodiments may have a plurality of pressure sensing textile elements (100) arranged as a large or small touchpad (107) and may also incorporate larger pressure sensitive areas (106) connected or coupled to an electronic control module (204), according to an example embodiment.

Figure 2:
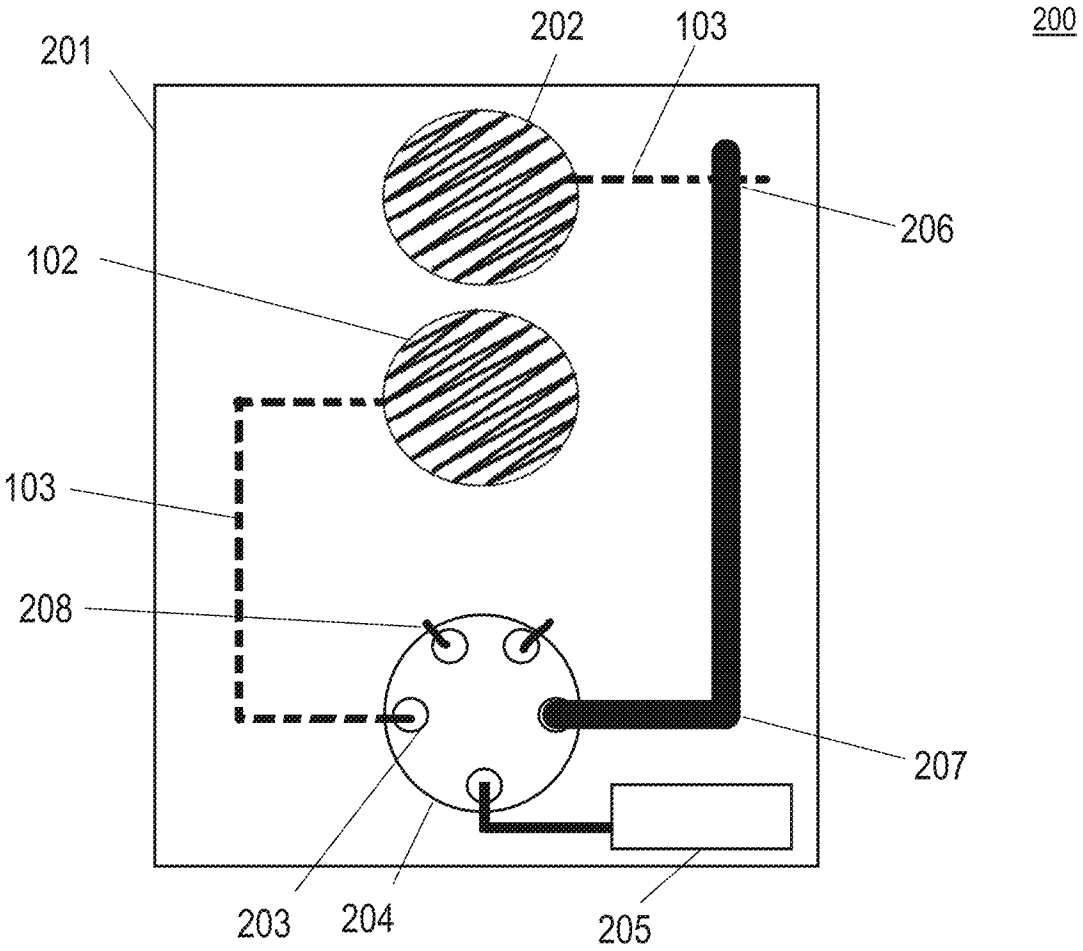
FIG. 2 depicts an example illustration of an example embodiment, which may include a detailed view of the first or third layer of FIG. 1 showing the detailed connection of the processor to the pressure sensing textile elements, according to an example embodiment.

FIG. 2 illustrates another exemplary embodiment where two pressure sensing textile elements are constructed on the same non-conductive textile layer (201), according to an example embodiment. In this example two circular conductive thread stitched pads (102, 202) may be connected or coupled to the circuit board of an electronic control module (204) by different techniques, according to an example embodiment. In this exemplary embodiment stitch pad 102 may be connected or coupled directly to the electronic control module (204) through conductive thread stitched trace (103) at location (203), according to an example embodiment. Conductive thread may be used to both secure the electronic circuit board in position and create an electronic connection to the circuit board by stitching through a via in the circuit board (203), where the via may be gold plated or otherwise prepared to accept the conductive thread connection, according to an example embodiment.

In this exemplary embodiment the conductive thread stitch pad (202) may be connected or coupled to an electronic control module (204) through a combination of conductive thread stitched traces (103) and non-thread based conductive traces (207), according to an example embodiment. Non-thread based conductive traces may include but not be limited to, conductive ink, sprays or wires, according to an example embodiment. Junction point (206) shows the junction between conductive thread stitched traces (103) and a non-thread based conductive traces (207), this transition may be accomplished by stitching conductive thread through conductive ink, or zig-zag stitching conductive thread over a wire trace, and may include spraying junction areas with, e.g., but not limited to, conductive paint or gel, or the like, according to an example embodiment. Various other example embodiments may also be used.

Figure 2A:
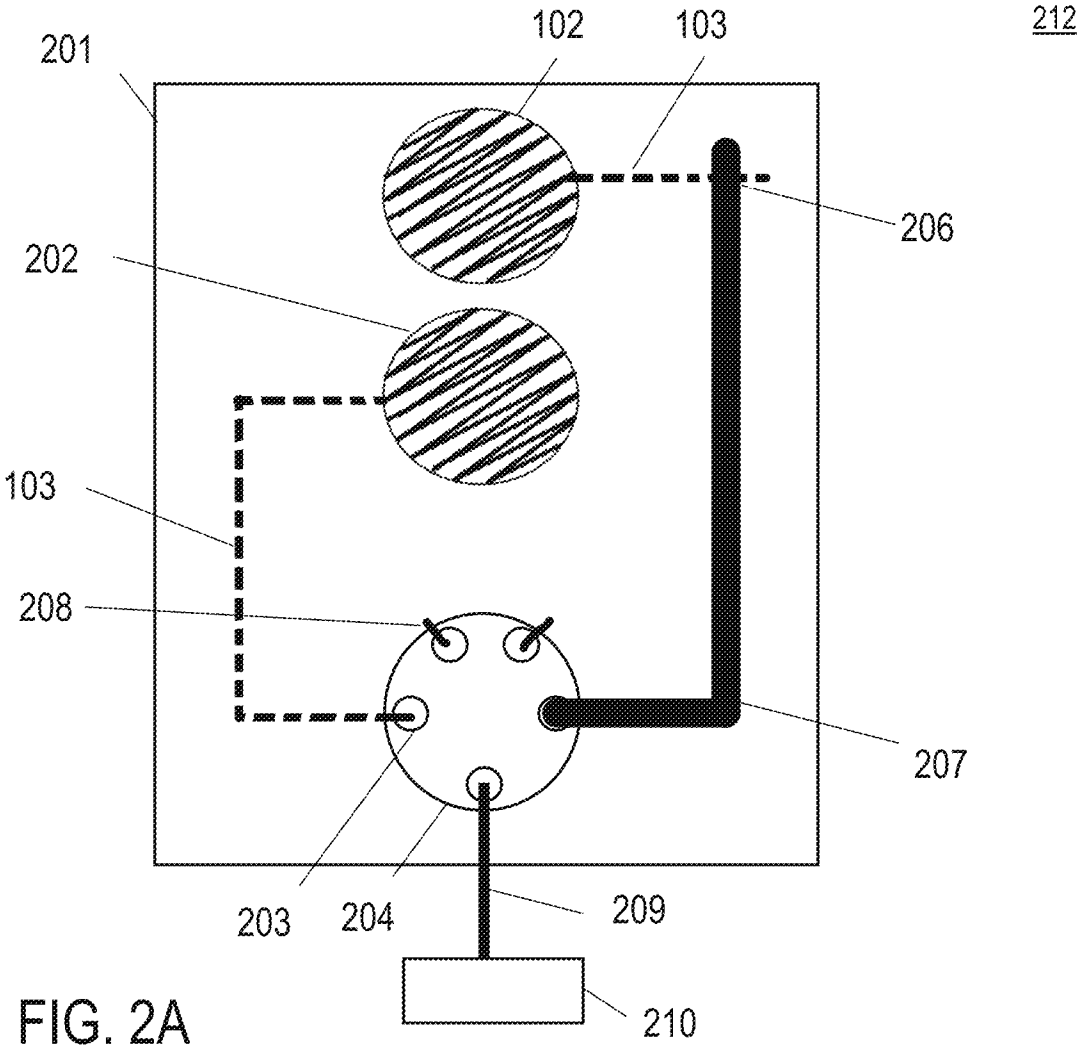
FIG. 2A depicts an example illustration of an example embodiment, which may include a diagram showing an exemplary embodiment of the first or third layer of FIG. 1 with an external battery, according to an example embodiment.
Figure 2B:
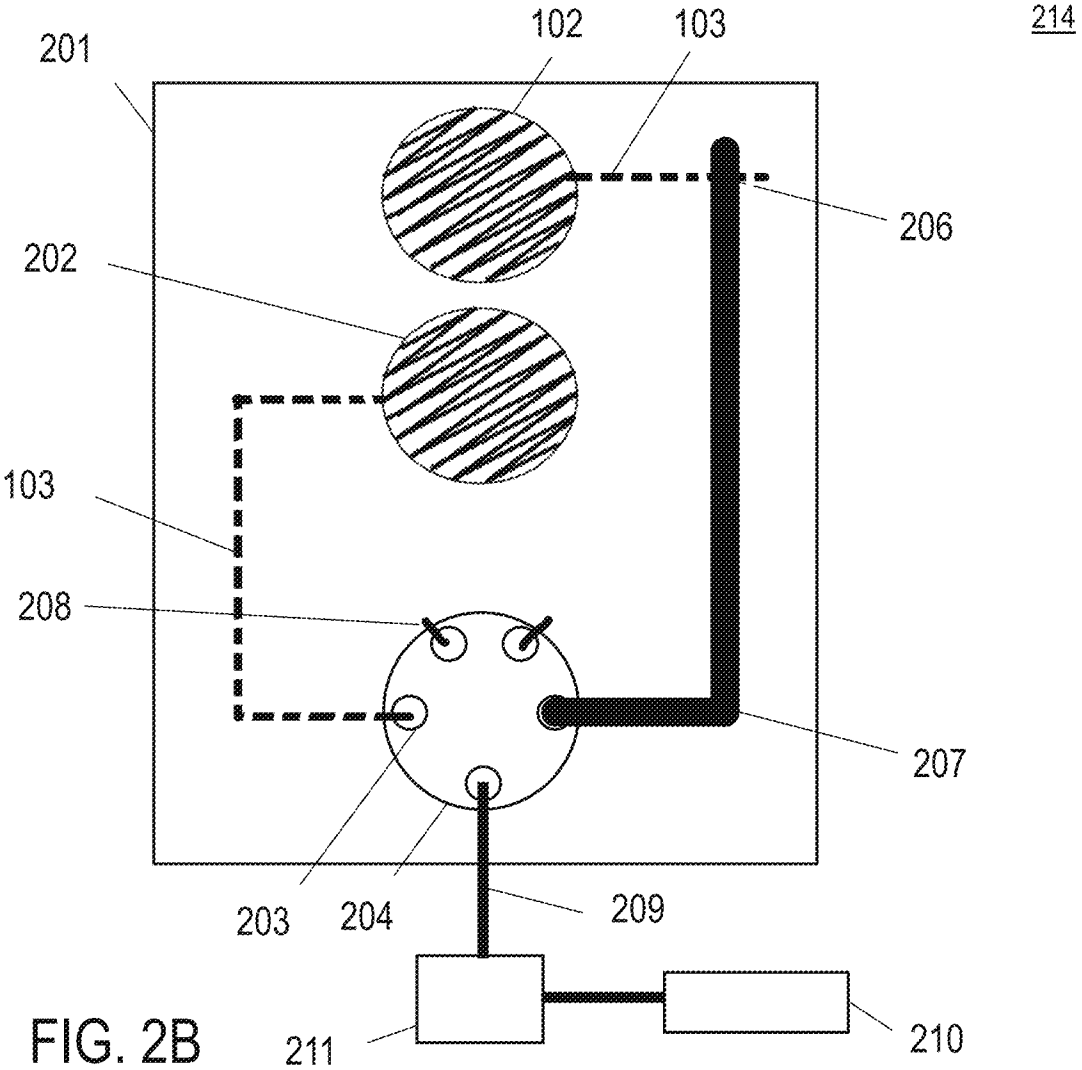
FIG. 2B depicts an example illustration of an example embodiment, which may include a diagram showing an exemplary embodiment of the first or third layer of FIG. 1 with an external circuit board and external battery, according to an example embodiment.

In the example of FIG. 2 the conductive thread stitching trace (103) from pad (102) may be embroidered directly into the circuit board through via (203) using an industrial embroidery machine, according to an example embodiment. Non-conductive thread (208) may embroidered into the circuit board through such vias (203) to secure the circuit board to the textile layer (201), according to an example embodiment. FIG. 2 also illustrates an embedded battery pack (205) that powers the electronic control module (204), according to an example embodiment. Other embodiments shown in FIG. 2A and FIG. 2B may connect to an external circuit board (211) or to an external power supply (210), or to both an external circuit board (211) and external power supply (210) through a cable connection (209), according to an example embodiment.

In some embodiments, (not shown in FIG. 2) the electronic control module (204) may be protected by a hard shell made of, but not limited to, metal, plastics, or elastomers, according to an example embodiment. This hard shell may be stitched, hot-pressed, adhered, or the like, to the textile to protect the processor circuit board from environmental and wear damage, according to an example embodiment.

Figure 3:
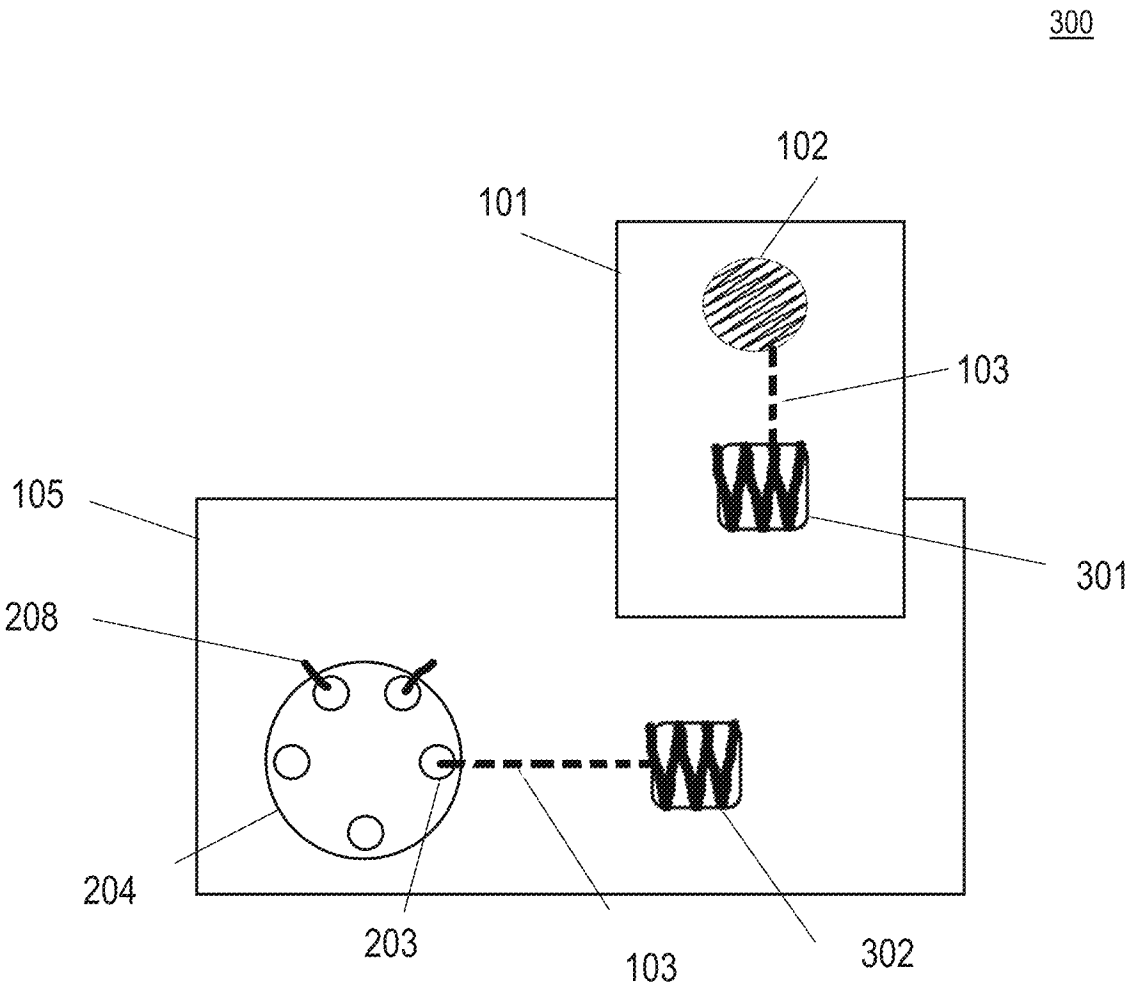
FIG. 3 depicts an example illustration of an example embodiment, which may include diagram showing the electronic connection between non-conductive textile layers, according to an example embodiment.
Figure 3A:
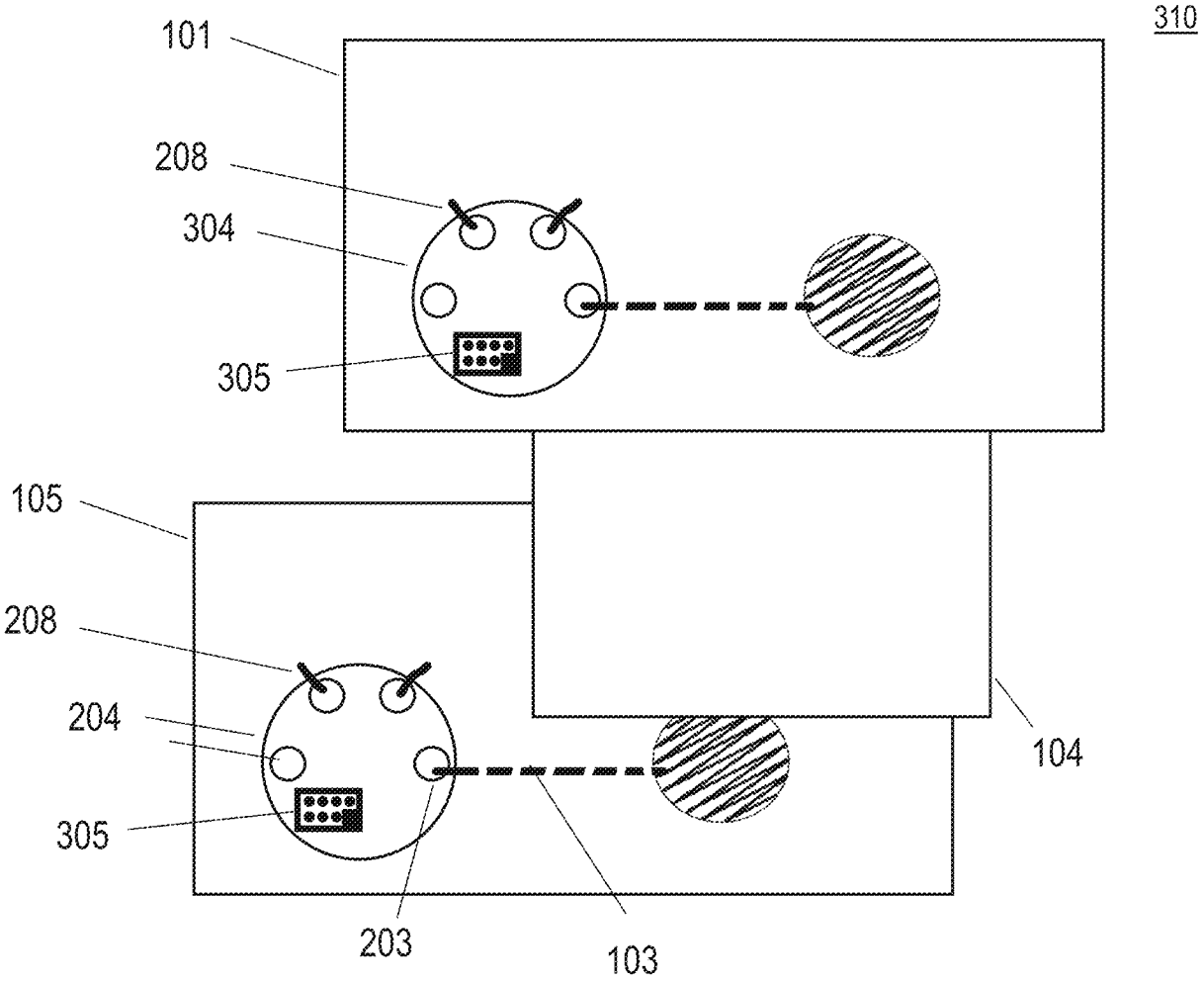
FIG. 3A depicts an example illustration of an example embodiment, which may include a diagram showing an exemplary embodiment of the circuit board on the first layer connecting directly into the circuit board on the third layer through an electronic pin connection, according to an example embodiment.

FIG. 3 illustrates an exemplary embodiment where electrical connection may be required directly between the first layer non-conductive textile layer (101) and the third non-conductive textile layer (105) without connecting to the pressure sensing material of the second layer (104), according to an example embodiment. A conductive thread stitched trace (103) connects to the electronic control module (204) through the circuit board via (203) to a conductive thread stitched pad (302), according to an example embodiment. The conductive thread stitched pad (301) on the first layer (101) may be positioned to align with the conductive thread stitched pad (302) on the third layer and the two pads are stitched together to make an electrical connection to the second conductive thread stitched trace (103) and thereby to the conductive thread stitched pad (102), according to an example embodiment. In this embodiment, there may be no pressure sensitive material between the layers (101) and (105), the purpose being to create a simple conductive path between the two layers, according to an example embodiment. The conductive thread stitched pad (302) may be made of conductive thread, but it can be made of conductive thread, ink, spray, wire, or the like, according to an example embodiment. Another embodiments shown in FIG. 3A may connect a circuit board on the third layer (204) directly to a circuit board on the first layer (304) through an electronic pin connector, according to an example embodiment.

One exemplary embodiment (not shown in the figures) may have a pad of conductive thread aligned to both the top and bottom surfaces of a non-conductive textile layer to provide a direct electrical connection between non-conductive layers which may be used for connecting, power, additional sensors, electrical components or other functions, according to an example embodiment.

Figure 4:
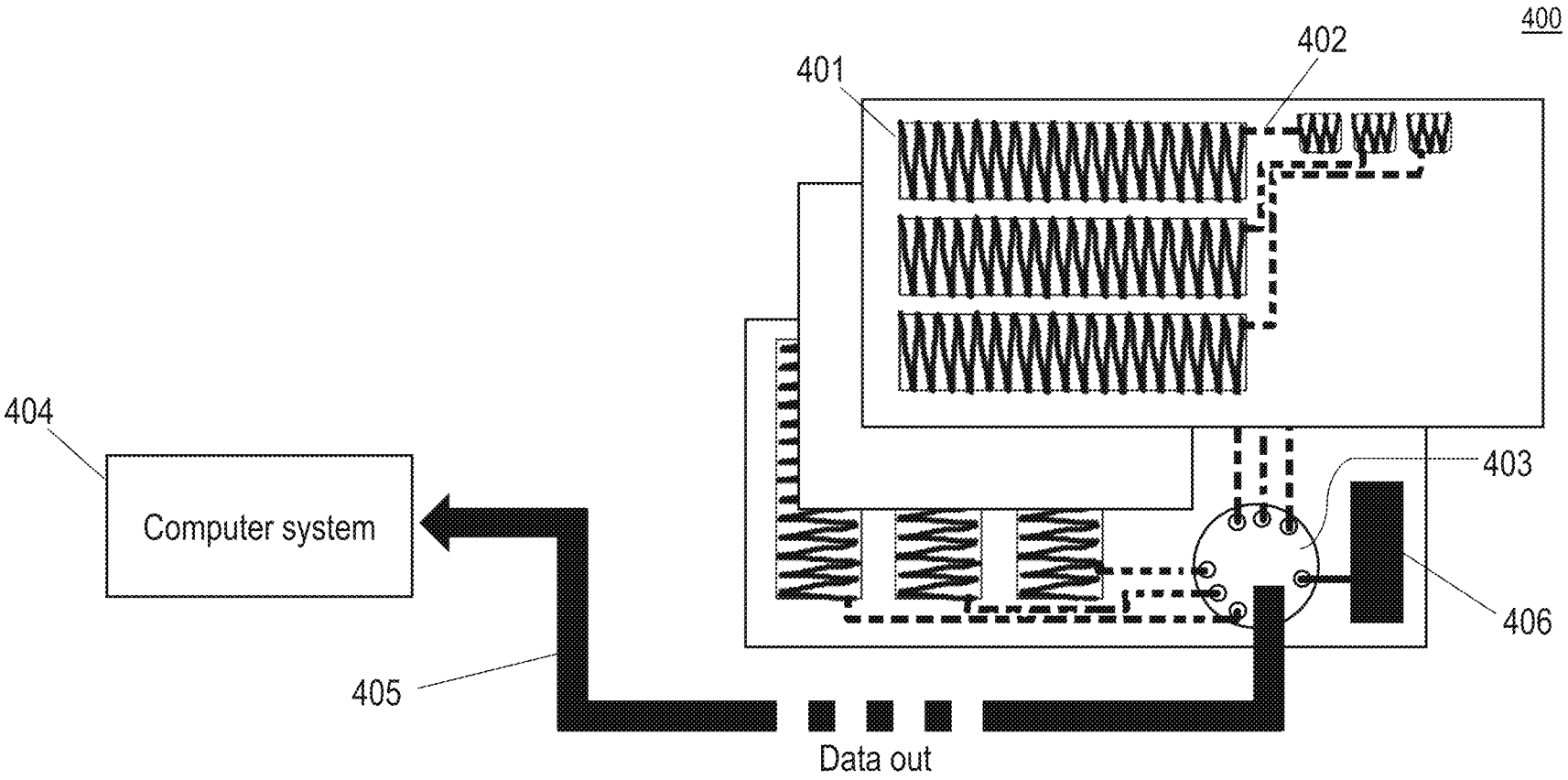
FIG. 4 depicts an example illustration of an example embodiment, which may include a diagram showing an exemplary embodiment of the invention system connecting to a computer system where an electronic control module and battery are internal to the embodiment, according to an example embodiment.
Figure 4A:
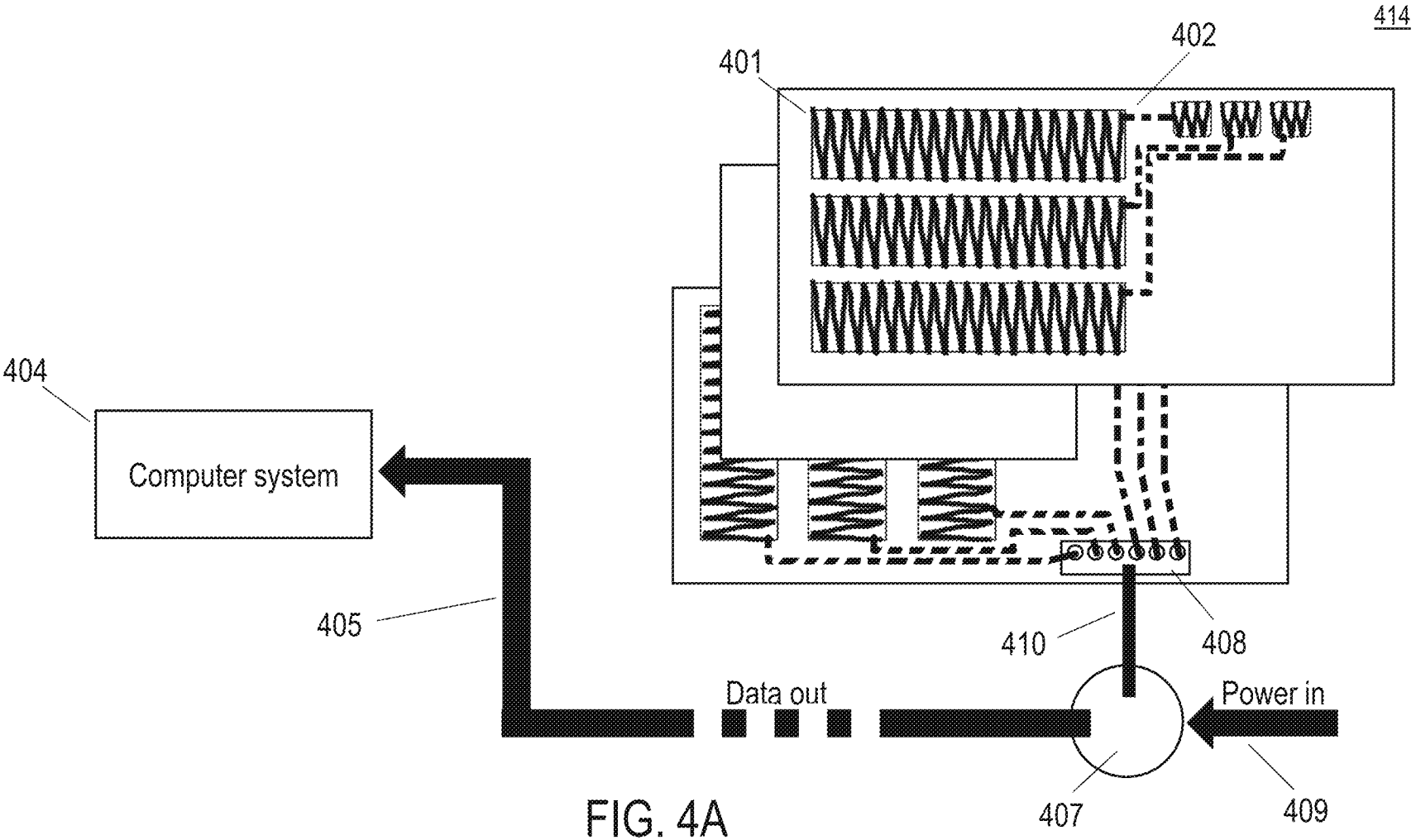
FIG. 4A depicts an example illustration of an example embodiment, which may include a diagram showing an exemplary embodiment of the invention system connecting to a computer system where an electronic control module and power are external to the embodiment, according to an example embodiment.

FIG. 4 illustrates an exemplary embodiment of the invention system which includes an exemplary pressure sensing system with an array of pressure sensing textiles (401) connected or coupled by conductive thread or wire (402) to an electronic control module (403), according to an example embodiment. The electronic control module (407) may be shown stitched onto the textile (FIG. 4) but may be external to the textile (FIG. 4A) and may be directly connected or coupled by wires (410) to conductive pads on the textile or to a terminal block stitched (408) onto the textile (FIG. 4A), according to an example embodiment. The electronic module may contain electronic circuitry that includes one or more of a microprocessor system, an analog to digital converter, electronic interface circuitry, according to an example embodiment. The control module may be configured to measure and collect sensor measurement information and connect to an external computer system (404) by one or more of a wired link, a wireless link or a fiber link (405), according to an example embodiment. The computer system (404) may be configured to at least one of:

- receive collected sensor information from the electronic control module
- transmit management and control information to the electronic control module
- store collected measurement data
- process collected measurement data
- display processed measurement data
- Perform an action based on the collected data
- Connect to an external system such as an alarm
- Connect to an Internet of Things (IoT) connected or coupled device Further, computer system (404) may connect to analysis and visualization software or connect to a set of Internet of Things devices, according to an example embodiment. In one embodiment the computer system may be Personal Computer, a cell phone, a tablet device, a laptop, or the like, according to an example embodiment.

Figure 4B:
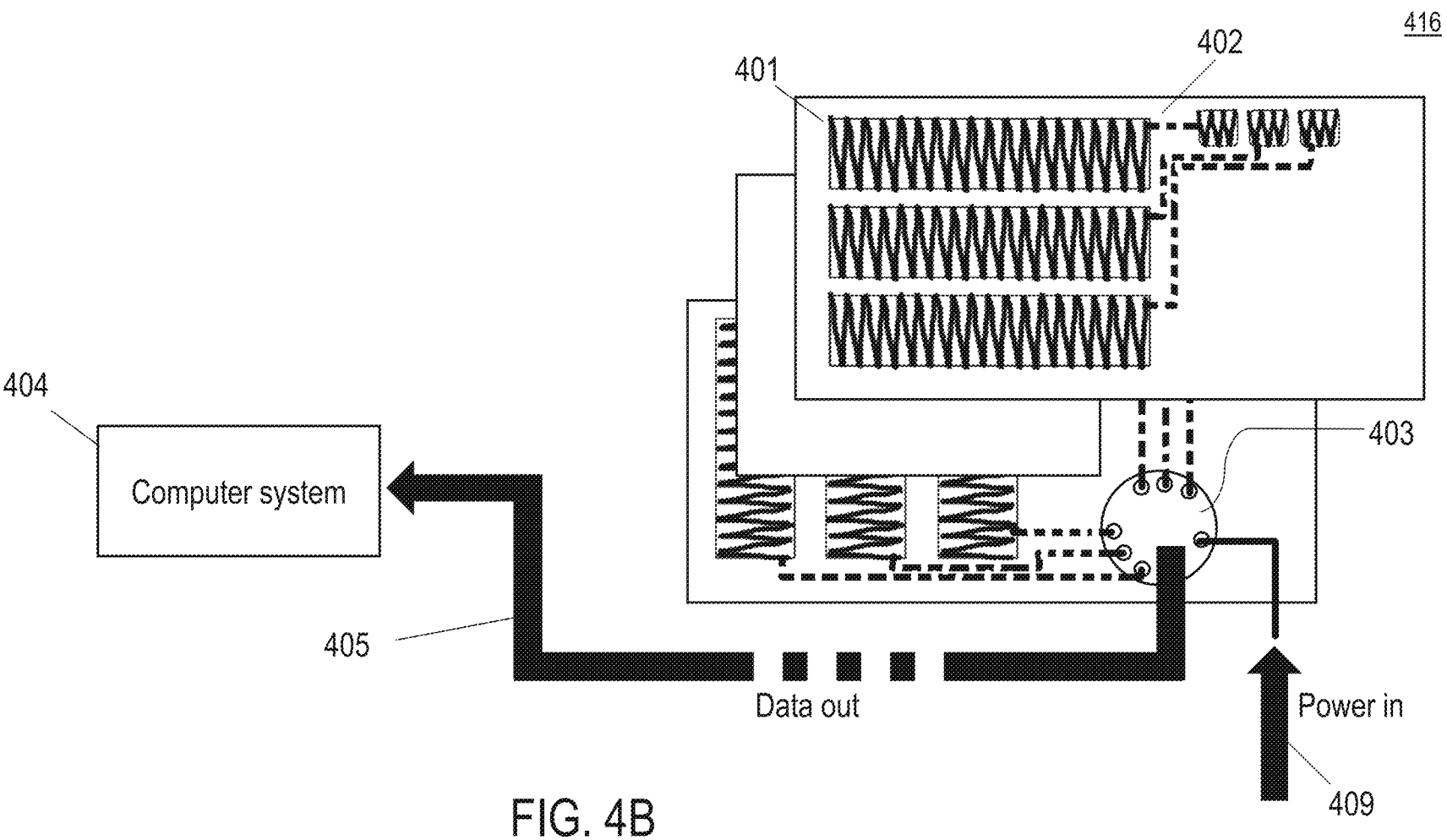
FIG. 4B depicts an example illustration of an example embodiment, which may include a diagram showing an exemplary embodiment of the invention system connecting to a computer system where an electronic control module may include internal and power may be external to the embodiment, according to an example embodiment.

Additional elements in the exemplary system include a battery (406) or other power source (409), which may be stitched or otherwise secured onto the textile or may be external to the textile (FIG. 4B) and connected or coupled to the control module via external wiring, according to an example embodiment.

An Exemplary Computer System Platform

Figure 5:
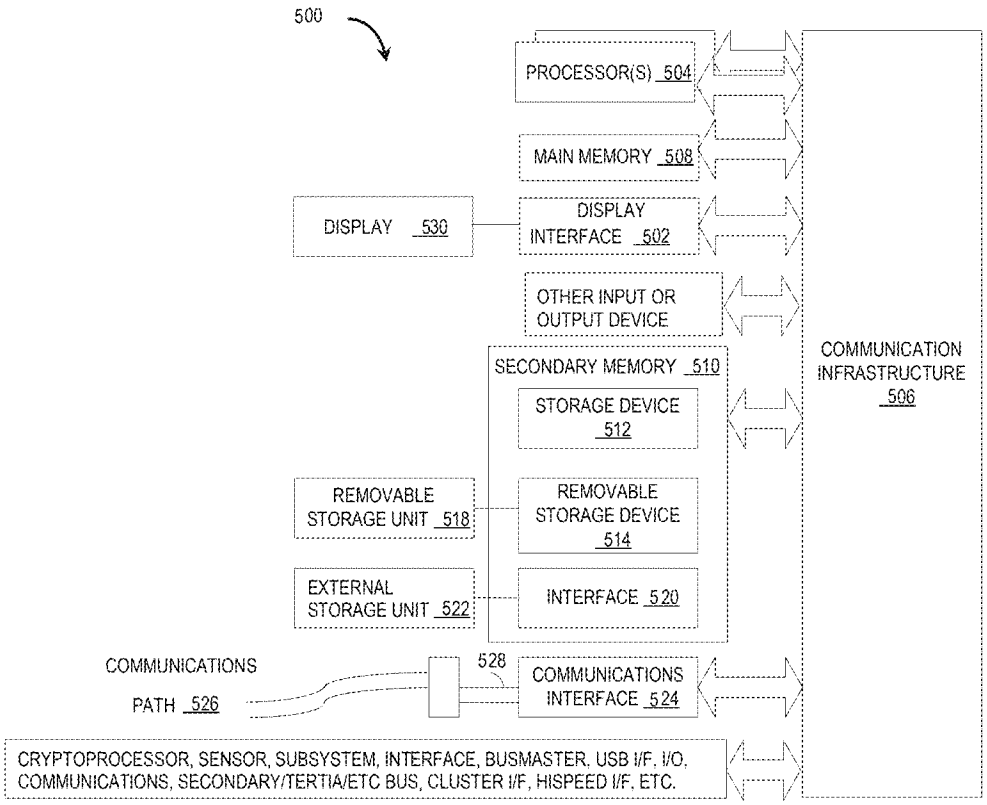
FIG. 5 depicts an example embodiment of a computer system as may be used, e.g., for computer device 404, or other computer systems as discussed herein, in various example embodiments.

FIG. 5 depicts an example block diagram 500, illustrating an example embodiment of an electronic computer processor-based device, which may be coupled to an example communications network and may be further electronically coupled to any of various well known electronic health record (HER), electronic medical record (EMR), and/or electronic patient record (EPR), an emergency related record, a health record, an electronic record, etc., of an example, but nonlimiting, electronic computing system device(s) of one or more health care workers in an example health care/medical care setting environment such as, e.g., but not limited to, a hospital, a patient care center, a medical care center, emergency room, patient room, nursing, provider, physical, physician assistant, general, specialist, medical staff, administrative staff, medical staff, surgical and/or other operating room, inpatient, outpatient, and/or in home, nursing care, assisted living, memory care and/or other care location, etc., according to one example embodiment. The present embodiments (or any part(s) or function(s) thereof) may be implemented using hardware, software, firmware, or a combination thereof and may be implemented in one or more computer systems or other processing systems. In fact, in one exemplary embodiment, the invention may be directed toward one or more computer systems capable of carrying out the functionality described herein. An example of a computer system 500 could be used as suggested by the figures, depicting an exemplary embodiment of a block diagram of an exemplary computer system useful for implementing the present invention. Specifically, an example computer 500, which in an exemplary embodiment may be, e.g., (but not limited to) a personal computer (PC) system running an operating system such as, e.g., (but not limited to) WINDOWS MOBILE™ for POCKET PC, or MICROSOFT® WINDOWS® NT/98/2000/XP/CE/, etc. available from MICROSOFT® Corporation of Redmond, WA, U.S.A., SOLARIS® from SUN® Microsystems of Santa Clara, CA, U.S.A., OS/2 from IBM® Corporation of Armonk, NY, U.S.A., MAC/OS, MAC/OSX, IOS, etc. from APPLE® Corporation of Cupertino, CA, U.S.A., etc., or any of various versions of UNIX® (a trademark of the Open Group of San Francisco, CA, USA) including, e.g., LINUX®, HPUX®, IBM AIX®, and SCO/UNIX®, etc. However, the invention may not be limited to these platforms. Indeed aspects of systems may include devices with various other input and/or output subsystems including, e.g., but not limited to, tablet displays, keyboards, various sensor(s), touch screen sensors, pressure sensors, location sensors (e.g., global positioning system (GPS), etc.), accelerometers, multi-dimensional sensor(s), temporal based datalogs, etc. Instead, the invention may be implemented on any appropriate computer system running any appropriate operating system. In one exemplary embodiment, the present invention may be implemented on a computer system operating as discussed herein. An exemplary computer system, computer 500. Other components of the invention, such as, e.g., (but not limited to) a computing device, a communications device, a telephone, a personal digital assistant (PDA), a personal computer (PC), a handheld PC, client workstations, thin clients, thick clients, proxy servers, network communication servers, remote access devices, client computers, server computers, peer-to-peer devices, tablets, touch-enabled devices, sensor enabled devices, location sensing devices, convertible, table/laptop, mobile, smart devices, smart phones, phablets, wearable technology, watch devices, glass devices, routers, web servers, data, media, audio, video, telephony or streaming technology servers, etc., may also be implemented using a computer and/or additional subsystems perhaps not all shown, as discussed.

The computer system 500 may include one or more processors, such as, e.g., but not limited to, processor(s) 504. The processor(s) 504 may be connected to a communication infrastructure 506 (e.g., but not limited to, a communications bus, cross-over bar, or network, etc.). Alternatively one or more subsystems can be built into an exemplary integrated circuit (IC), and/or application specific integrated circuits (ASICs), field programmable gate arrays (FPGAs), etc. Various exemplary software embodiments may be described in terms of this exemplary computer system. After reading this description, it will become apparent to a person skilled in the relevant art(s) how to implement the invention using other computer systems and/or architectures.

Computer system 500 may include a display interface 502 that may forward, e.g., but not limited to, graphics, text, and other data, etc., from the communication infrastructure 506 (or from a frame buffer, etc., not shown) for display on the display unit 530.

The computer system 500 may also include, e.g., but may not be limited to, a main memory 508, random access memory (RAM), and/or a secondary memory 510, etc. The secondary memory 510 may include, for example, (but not limited to) a hard disk drive 512, flash memory, a storage device, and/or a removable storage drive 514, representing a floppy diskette drive, a magnetic tape drive, an optical disk drive, a compact disk drive CD-ROM, DVD, BLU-RAY, etc. The removable storage drive 514 may, e.g., but not limited to, read from and/or write to a removable storage unit 518 in a well known manner. Removable storage unit 518, also called a program storage device or a computer program product, may represent, e.g., but not limited to, a floppy disk, magnetic tape, optical disk, compact disk, etc. which may be read from and written to by removable storage drive 514. As will be appreciated, the removable storage unit 518 may include a computer usable storage medium having stored therein computer software and/or data.

In alternative exemplary embodiments, secondary memory 510 may include other similar devices for allowing computer programs or other instructions to be loaded into computer system 500. Such devices may include, for example, a removable storage unit 522 and an interface 520. Examples of such may include a program cartridge and cartridge interface (such as, e.g., but not limited to, those found in video game devices), a removable memory chip (such as, e.g., but not limited to, an erasable programmable read only memory (EPROM), or programmable read only memory (PROM) and associated socket, flash memory, SDRAM, USB memory device, DVD-ROM, CD-ROM, BLU-RAY, etc., and other removable storage units 522 and/or interfaces 520 which may allow software and data to be transferred from the removable storage unit 522 to computer system 500.

Computer 500 may also include an input device such as, e.g., (but not limited to) a mouse or other pointing device such as a digitizer, and a keyboard or other data entry device (none of which are labeled).

Computer 500 may also include output devices, such as, e.g., (but not limited to) display 530, touchscreen, passive, active, thin-film-transistor (TFT), passive touch, active touch, stylus enabled sensor based interface, flat panel, LCD, LED, and/or CRT, etc. and/or display interface 502. Computer 500 may include input/output (I/O) devices such as, e.g., (but not limited to) communications interface 524, cable 528 and communications path 55, etc. These devices may include, e.g., but not limited to, a network interface card, and modems (neither are labeled). Communications interface 524 may allow software and data to be transferred between computer system 500 and external devices. Examples of communications interface 524 may include, e.g., but may not be limited to, a modem, a network interface (such as, e.g., an Ethernet card), a communications port, a Personal Computer Memory Card International Association (PCMCIA) slot and card, Universal Serial Bus, Busmaster interface, PCI bus, interface bus, card slot, and/or other interface, firewire, USB 1, 2, 3, . . . n, A, B, C, D, . . . x, including any comparable interface released in the future, from a standards body, or the like, etc. Software and data transferred via communications interface 524 may be in the form of signals 528 which may be electronic, electromagnetic, optical or other signals capable of being received by communications interface 524. These signals 528 may be provided to communications interface 524 via, e.g., but not limited to, a communications path 526 (e.g., but not limited to, a channel). This channel 526 may carry signals 528, which may include, e.g., but not limited to, propagated signals, and may be implemented using, e.g., but not limited to, wire or cable, fiber optics, a telephone line, a cellular link, a radio frequency (RF) link and other communications channels, etc.

In this document, the terms "computer program medium" and "computer readable medium" may be used to generally refer to media such as, e.g., but not limited to removable storage drive 514, a hard disk installed in hard disk drive 512, and signals 528, etc. These computer program products may provide software to computer system 500. The invention may be directed to such computer program products.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still co-operate or interact with each other.

An algorithm is here, and generally, considered to be a self-consistent sequence of acts or operations leading to a desired result. These include physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like. It should be understood, however, that all of these and similar terms are to be associated with the appropriate physical quantities and are merely convenient labels applied to these quantities.

Unless specifically stated otherwise, as apparent from the following discussions, it is appreciated that throughout the specification discussions utilizing terms such as "processing," "computing," "calculating," "determining," or the like, refer to the action and/or processes of a computer or computing system, or similar electronic computing device, that manipulate and/or transform data represented as physical, such as electronic, quantities within the computing system's registers and/or memories into other data similarly represented as physical quantities within the computing system's memories, registers or other such information storage, transmission or display devices.

In a similar manner, the term "processor" may refer to any device or portion of a device that processes electronic data from registers and/or memory to transform that electronic data into other electronic data that may be stored in registers and/or memory. A "computing platform" may comprise one or more processors.

Embodiments of the present invention may include apparatuses for performing the operations herein. An apparatus may be specially constructed for the desired purposes, or it may comprise a general purpose device selectively activated or reconfigured by a program stored in the device, and/or a special purpose device programmed according to various algorithms and/or flowcharts and processes/methods as described at length herein.

Embodiments of the invention may be implemented in one or a combination of hardware, firmware, and software. Embodiments of the invention may also be implemented as instructions stored on a machine-readable medium, which may be read and executed by a computing platform, which may include one or more processors, such as, e.g., but not limited to, a microprocessor, a multi-core processor, a quad-core processor, a central processing unit (CPU), a quantum computer, a nanoprocessor, a computational engine, an information appliance, a virtual processor, a co-processor, a busmaster processor, a graphics processor (GPU), a digital signal processor (DSP), and/or other processor, to perform the operations described herein. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical, magneto-optical, SD-RAM, SDCard, and/or other form of non-transitory medium storing any propagated signals (e.g., carrier waves, infrared signals, digital signals, etc.), and others.

Computer programs (also called computer control logic), may include object oriented computer programs, and may be stored in main memory 508 and/or the secondary memory 510 and/or removable storage units 514, also called computer program products. Such computer programs, when executed, may enable the computer system 500 to perform the features of the present invention as discussed herein. In particular, the computer programs, when executed, may enable the processor 504 to provide a method to resolve conflicts during data synchronization according to an exemplary embodiment of the present invention. Accordingly, such computer programs may represent controllers of the computer system 500.

In another exemplary embodiment, the invention may be directed to a computer program product comprising a computer readable medium having control logic (computer software) stored therein. The control logic, when executed by the processor 504, may cause the processor 504 to perform the functions of the invention as described herein. In another exemplary embodiment where the invention may be implemented using software, the software may be stored in a computer program product and loaded into computer system 500 using, e.g., but not limited to, removable storage drive 514, hard drive 512 or communications interface 524, etc. The control logic (software), when executed by the processor 504, may cause the processor 504 to perform the functions of the invention as described herein. The computer software may run as a standalone software application program running atop an operating system, or may be integrated into the operating system.

In yet another embodiment, the invention may be implemented primarily in hardware using, for example, but not limited to, hardware components such as application specific integrated circuits (ASICs), or one or more state machines, etc. Implementation of the hardware state machine so as to perform the functions described herein will be apparent to persons skilled in the relevant art(s).

In another exemplary embodiment, the invention may be implemented primarily in firmware.

In yet another exemplary embodiment, the invention may be implemented using a combination of any of, e.g., but not limited to, hardware, firmware, and software, etc.

Exemplary embodiments of the invention may also be implemented as instructions stored on a machine-readable medium, which may be read and executed by a computing platform to perform the operations described herein. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or nontransitory versions of other forms of previously propagated signals (e.g., carrier waves, infrared signals, digital signals, etc.), and others.

Still referring to the figures, a universal integrated circuit card (UICC) (not shown) comprising a subscriber identity module and possibly a secure storage and/or cryptoprocessor can also coupled to the application or system processor. The system may further include a security processor (not shown) that may couple to the application or system processor or CPU.

One or more, or a plurality of sensors may couple to processor, or application processor to enable input of a variety of sensed information such as accelerometer and other environmental information. An audio, and/or video, output device may provide an interface to output sound, and/or other data, e.g., in the form of voice communications, played or streaming audio data and so forth.

As further illustration of the figures, an exemplary near field communication (NFC) contactless interface can be provided in certain embodiments, that can communicate in a NFC near field via an NFC antenna, for example (not shown). While separate antennae can be used, not all are shown in figures for simplicity of illustration, but will be apparent to those skilled in the relevant art, understand that in some implementations can include one or more antenna (ae) or a different set of antennae may be provided to enable various wireless functionality.

Further, an exemplary power management integrated circuit (PMIC) can couple to application processor, or system processor, to perform platform level power management. To this end, PMIC (not shown) may issue power management requests to application processor, system processor, etc., to enter certain low power states as desired. Furthermore, based on platform constraints, PMIC may also control the power level of other components of the exemplary system as shown in figures. To enable communications to be transmitted and received, various circuitry may be coupled between an exemplary baseband or other system processor and/or an antenna (not necessarily shown in the block diagram). Specifically, a radio frequency (RF) transceiver and/or a wireless local area network (WLAN) transceiver, and/or a network interface card (NIC) may be present, in certain exemplary embodiments. In general, RF transceivers may be used to receive and transmit wireless data and calls according to a given wireless communication protocol such as, e.g., but not limited to, 3G, 4G, 5G, nG, next generation (NG), etc. wireless communication protocol such as in accordance with a code division multiple access (CDMA), global system for mobile communication (GSM), long term evolution (LTE) or other protocol. In addition a GPS sensor may be present in certain embodiments (not necessarily shown in block diagram). Other wireless and/or wired communications such as, e.g., but not limited to, receipt or transmission of radio signals, e.g., AM/FM, Wi-Fi, WiMAX, etc., and other signals may also be provided, on a local area, and/or a wide area basis. In addition, via an exemplary WLAN transceiver, local wireless communications can also be realized.

Further referring to the figures, shown is a block diagram of another example system with which embodiments may be used. In the illustration of exemplary systems herein, some communications devices may be mobile, and/or portable, and/or, low-power system(s) such as, e.g., but not limited to, a tablet computer, 2:1 tablet, phablet, a smartphone, a laptop, a notebook, a portable computer, a personal computer, a telephony device, a cellphone, an ultrabook, a GOOGLE CHROME book, etc, a thick client, a fat client, a thin client, and/or convertible and/or standalone, and/or desktop and/or tablet system. As illustrated, a system on a chip (SoC) can also be used and may be configured to operate as a system processor, and/or an application processor for the device.

A variety of devices may couple to an exemplary SoC. In the illustration shown, a memory subsystem may include an exemplary flash memory and/or a DRAM coupled to a SoC, and/or processor and/or controller, and/or microcontroller. In addition, a touch panel 1320 is coupled to the SoC, etc. to provide display capability and/or user input via exemplary touch and/or other interface, including, e.g., but not limited to, provision of an actual, and/or virtual keyboard, and/or other input device, which can be alternatively displayed on an exemplary display of an exemplary touch enabled display panel monitor, or other output device or screen, according to exemplary embodiments.

To provide wired network connectivity, SoC or system processor can couple to an exemplary network interface such as, e.g., but not limited to, an exemplary Ethernet interface. A peripheral hub can be coupled to SoC or system processor, in some embodiments, to enable interfacing with various peripheral devices, such as may be coupled to system by any of various ports and/or other connectors. Various other output devices can include any of various indicators such as, e.g., but not limited to, display interfaces, LEDs, LCDs, etc., interfaces, command line interfaces, graphical user interfaces, etc.

In addition to internal power management circuitry and functionality optionally provided in some embodiments, within SoC or system processor, or a PMIC can be coupled to exemplary SoC or system processor embodiments to provide exemplary platform-based power management, e.g., based on whether the system is powered by a battery, or AC power, via an AC adapter, and/or uninterruptible power supply or other power source, in an exemplary embodiment. In addition to this power source-based power management, PMIC may further perform platform power management activities based on environmental and usage conditions in some embodiments. Still further, PMIC may communicate control and status information to SoC or system processor or controller to cause various power management actions within SoC or system processor, in exemplary embodiments.

Still referring to the figures, to provide for exemplary communication functions, such as, e.g., but not limited to, wired capabilities, and/or wireless capabilities, a communication interface, such as, e.g., a WLAN unit can be coupled to SoC or system processor and/or in turn to an exemplary antenna. In various implementations, WLAN unit or other communications devices may provide for communication according to one or more wireless and/or wired communications protocols, as described herein, and as would be apparent to those skilled in the relevant art.

In illustrative embodiments, a plurality of sensors (not shown) may couple to SoC and/or the system processor. These sensor(s) may include, e.g., but not limited to, various accelerometer, environmental and other sensors, including, e.g., but not limited to, user gesture sensors, range finders, location based sensors, gyroscopic, pressure, flow, laser, electronic, optical, light based, displacement, radar, lidar, temperature, touch, ultrasonic, and/or other well known sensors, etc. Finally, an audio codec, and/or an analog to digital converter, and/or digital to analog converter, can be coupled to SoC or system processor to provide an interface to an exemplary audio input and/or output device. Of course, as will be understood to those skilled in the relevant art, such examples are intended merely as way of example, but not limitation, and that whether shown or not shown, discussed, or not discussed, are intended still to potentially fall with this particular implementations as described in the exemplary figures, however many variations and alternatives are possible within the scope of the claims as set forth below.

The exemplary embodiment of the present invention makes reference to wired, or wireless networks. Wired networks include any of a wide variety of well known ways for coupling voice and data communications devices together. A brief discussion of various exemplary wireless network technologies that may be used to implement the embodiments of the present invention now are discussed. The examples are non-limited. Exemplary wireless network types may include, e.g., but not limited to, code division multiple access (CDMA), spread spectrum wireless, orthogonal frequency division multiplexing (OFDM), 1G, 2G, 3G, 4G, 5G, 6G, n-G (any future wireless standard), next generation (NG), wireless, Bluetooth, Infrared Data Association (IrDA), shared wireless access protocol (SWAP), "wireless fidelity" (Wi-Fi), WIMAX, and other IEEE standard 802.11-compliant wireless local area network (LAN), 802.16-compliant wide area network (WAN), and ultrawideband (UWB), etc.

Bluetooth is a wireless technology promising to unify several wireless technologies for use in low power radio frequency (RF) networks.

IrDA is a standard method for devices to communicate using infrared light pulses, as promulgated by the Infrared Data Association from which the standard gets its name. Since IrDA devices use infrared light, they may depend on being in line of sight with each other.

The exemplary embodiments of the present invention may make reference to WLANs. Examples of a WLAN may include a shared wireless access protocol (SWAP) developed by Home radio frequency (HomeRF), and wireless fidelity (Wi-Fi), a derivative of IEEE 802.11, advocated by the wireless Ethernet compatibility alliance (WECA). The IEEE 802.11 wireless LAN standard refers to various technologies that adhere to one or more of various wireless LAN standards. An IEEE 802.11 compliant wireless LAN may comply with any of one or more of the various IEEE 802.11 wireless LAN standards including, e.g., but not limited to, wireless LANs compliant with IEEE std. 802.11a, b, d, g, n, etc. such as, e.g., but not limited to, IEEE std. 802.11 a, b, d, g, n, (including, e.g., but not limited to IEEE 802.11g-2003, etc.), IEEE 802.16, Wi-MAX, etc.

Wide area networks (WANs) allow extending of computer networks over large distances, connecting or coupling remote branch offices to data centers and to other branch offices, and delivery of applications and services required to perform business functions. When entities like companies or government agencies extend networks over greater distances and sometimes across multiple carriers; networks, the entities can face operational challenges including, e.g., but not limited to, latency, network congestion, jitter, packet loss, and/or even service outages, etc. Modern communications related applications such as, e.g., but not limited to, voice over internet protocol (VoIP) calling, videoconferencing, streaming media, and/or virtualized applications and/or desktops, etc., can require low latency. Bandwidth requirements are also continually increasing, especially for applications featuring high-definition video, and the like. Expanding WAN capability can be expensive and difficult with corresponding difficulties related to network management and troubleshooting.

Certain example embodiments may include further improvements, such as, e.g., but not limited to, where embroidered wire or the like is demonstrated in random or periodically repeating patterns, such embroidered wire may further be used to represent some other symbol, image, text, cursive writing, graphics, etc. The computer system as represented herein may include other functionality as is well known including, e.g., but not limited to, audio and/or video, text and/or other images or content, e.g., that may appear in books, music, movies, videos, computer games, 3D visualizations, holograms, and/or virtual reality and augmented reality experiences, among other things. Certain embodiments may make use of artificial intelligence, machine learning, large AI databases, OpenAI, ChatGPT, other AI systems, expert systems, neural networks, executive information systems, decision support systems, natural language search, voice recognition, speech recognition, etc. Similarly, the systems and devices may be of various different form factors and can also take a variety of different forms. For example, computing devices may include, e.g., but not limited to, computers, mobile devices, handheld devices, portable computers, servers, clients, workstations, desktops, notebooks, laptops, digital eBook readers, tablets, phablets, computers, personal computers, handheld devices, phones, mobile phones, smart phones, wearables, smart watches, glasses, neural chips, monitors, televisions and/or projection devices, etc. Such devices may also include, e.g., but not limited to wearable interactive devices, such as, e.g., but not limited to, holographic glasses, augmented reality goggles, mixed reality devices, internet contact lenses, and virtual reality headsets, etc., embedded devices, devices coupled to one's person, prosthetics, internal and external systems, interfaced systems, etc. These devices may contain electronic computer processors, systems on a chip, embedded processors, microcontrollers, FPGAs, ASICs, ICs, VLSI, and electronic computer memory storage devices, memory devices, FLASH devices, etc., configured to process and/or store data, machine learned data, user preferences, user history, content, aggregated data and artificial intelligence algorithms, among other things. The devices may contain one or more electronic sensors, or may be used in combination or alone, as a sensor, an electronic sensor, an electromechanical sensor, as well as with other devices including optical devices, electronic devices, magneto-optical devices, optical fiber communications systems, wired communications systems, wireless communication systems, etc., as well as other sensors such as, e.g., but not limited to, cameras, microphones, accelerometers, gyroscopes, pressure and temperature sensors, magnetometers, global positioning systems, audio level detection, light detection and ranging (LIDAR), laser, radio, and ambient light sensors, proximity, distance, intrusion detection, access control systems, etc. The sensors may also include or may be integrated with, or coupled to, e.g., but not limited to, barometers, humidity and proximity sensors, touch sensors, fluid sensors, external surface sensors, fingerprint sensors, activity sensors, health sensors, accelerometer, inertial measurement units, altimeter, altitude measurement subsystems, height/depth, and other sensing units, ultrasonic and rangefinder, as well as other well known sensors, etc. Such devices can be connected to a communications network, such as, e.g., but not limited to, voice, data, cable, wired or wireless, public or private, intranet or internet, the Global Internet, cellular, satellite, bus or star topologies, local area, personal area, or wide area, wireless communications networks including, e.g., but not limited to, Wi-Fi, 1G-4G, 5G, nG, Starlink, WiMax, point-to-point, point-to-multipoint, short distance, BLUETOOTH, personal area networks, routers, gateways, etc., configured to communicate with other exemplary systems and devices, etc.

Three dimensional printing technologies and other materials may be used in other embodiments. Medical grade materials for incorporation into systems adapted for interface to humans may be further included, in example embodiments. An example prosthetic device which can fabricated of e.g., but not limited to DACRON®, GORETEX®, or other suitable material. Examples of medical systems include the ENDURANT® II, stent grafts systems available from Medtronic Corporation of Minneapolis, Minn. USA and/or a GORE® EXCLUDER® AAA Endoprosthesis, available from Gore Medical, a division of W.L. Gore & Associates, Inc., Medical Products Division, Flagstaff, Ariz., USA, and such systems could be integrated with materials as discussed in the present disclosure to provide systems capable of embedding with proper shielding and/or insulation, in an example system coupled to humans as a prosthetic touch sensor, in one example embodiment. The device can include where the example prosthetic touch sensor can include, e.g., but is not limited to at least one polymer material can include but is not limited to at least one of: PS, ABS, SAN, PMMA, PPE, PP, PE, PA, PC, PET, PA, POM, PMP, PPP, PC-HT, PEI, PSU, PES, PPSU, PAI, PI, PVDF, ETFE, PCTFE, PTFE, ePTFE, PFA, LCP, PPS, PEEK, PEK, PEKEKK, FEP, PFA, nylon, fluoropolymer, LCP, or engineered plastic. In one exemplary embodiment, the device can be integrated with, and/or created with, and/or, wrapped in, a wire mesh, such as, e.g., but not limited to, a Nitinol, shape memory metal, and/or other wire material mesh, in order to provide improved and compact delivery to a deployed locations, over conventional devices. The device may be integrated with other example systems such as, e.g., but not limited to, devices as described in U.S. Pat. Nos. 11,064,909B2, 10,206,793B2, 10,376,155B2, US20220133173A1, and US20070038311A1, the contents of all of which are incorporated herein by reference in their entireties.

Certain example embodiments may include additional processing including artificial intelligence and machine learning, artificial intelligence and/or other intelligent analysis, and/or machine learning analysis, predictive analysis, categorization and generative technologies, etc., enhanced functionality and features according to other example embodiments.

Exemplary artificial intelligence systems may include any of various well known systems including, e.g., but not limited to, neural networks, expert systems, etc. can be refined via machine learning, such as, e.g., but not limited to, using predictive analytic techniques, artificial intelligence (AI) techniques, automated topic identification (see e.g., U.S. Pat. No. 9,442,928B2, US20160314184A1, the contents of both of which are incorporated herein by reference in their entireties), generative AI (see e.g., US Patent US20220366251A1, the contents of which is incorporated herein by reference in its entirety), heuristics, machine learning (ML), neural networks and rules based expert systems, and the like, according to exemplary embodiments. an exemplary embodiment of an exemplary artificial intelligence (AI) platform, available from GOOGLE, a division of ALPHABET CORPORATION, of Palo Alto, CA USA, which is an exemplary, but nonlimiting machine learning (ML) platform enabling development of ML projects from ideation to production and deployment, enabling data engineering, flexibility, and an integrated tool chain for building and running ML predictive analytics applications, supporting a KUBEFLOW open-source platform, allows building portable ML pipelines, which can run on-premises or on cloud without significant code change, and including TENSORFLOW, TPUs, and TFX tools as enabling deployment of production AI applications, according to an exemplary embodiment; such as, e.g., an exemplary embodiment of an exemplary GOOGLE cloud AI technology stack as can be used to implement any of various exemplary embodiments.

In one embodiment, the insertion location, according to an exemplary embodiment, is determined using an artificial intelligence or a machine learning method. In one embodiment, the machine learning method may comprise, e.g., but not limited to, one of a supervised learning method, an unsupervised learning method or reinforcement learning method. The machine learning method, according to an exemplary embodiment, may comprise one or more of, e.g., but not limited to, linear regression, logistic regression, decision tree, support vector machine (SVM), naive bayes, k-nearest neighbors (kNN), k-means clustering, random forest, dimensionality reduction, and/or gradient boosting algorithm, etc.

According to an exemplary embodiment, the method may include analysis and processing related to textile construction where the system makes certain determinations for optimal pad or via placement, for example, by the at least one electronic computer processor, using an artificial intelligence or a machine learning method.

According to an exemplary embodiment, the method may include, e.g., but not limited to, where the machine learning method may may include, e.g., but not limited to, at least one or more of: a supervised learning method, an unsupervised learning method, or a reinforcement learning method.

According to an exemplary embodiment, the method may include, e.g., but not limited to, where the machine learning method may may include, e.g., but not limited to, at least one or more of: linear regression, logistic regression, decision tree, support vector machine (SVM), naive bayes, k-nearest neighbors (kNN), k-means clustering, random forest, dimensionality reduction, or gradient boosting algorithm.

According to an exemplary embodiment, the method may include, e.g., but not limited to, where the processing may include, e.g., but not limited to, analyzing and determining certain parameters, by the at least one electronic computer processor, based on a score for each of the various parameters, wherein the score is determined based on weighted summation of parameter criteria scores of two or more parameters.

From a data model, which can automate certain subprocesses of creating an exemplary computer-implemented textile manufacturing process system, and related controller service provider computer system, can process incoming electronic data and can transform the data into exemplary computer-implemented analysis and management system, and/or transformed data, in the form of data indicative of the one or more interfaced exemplary computer-implemented example embodiment of an example mobile app, computer app, client and/or server based, and/or cloud-based, web-browser based, or console-based, IoT, and/or integrated with advanced AI functionality and/or machine learning system, process, computer program product, and/or social media system, and/or communication system, and/or computer system, and/or client or service device system hardware architecture, storage device sizing and management system amounts, electronic database, and electronic funds process, and disbursement information, and processing to initiate electronic disbursement, and/or can be provided to an electronic decision support system (DSS), and/or computer database management system (DBMS)(which can be a relational database, and/or can use a graph database, an SQL database, a noSQL database, and/or other social networking and/or graph database, and/or electronic interactive, graphical user interface (GUI) system (not shown). Each of the exemplary DSS, DBMS and/or EIGUI system, can then, using e.g., but not limited to, a cryptographic processor and/or a crypto chip controller, or the like, can then encrypt the data using electronic encryptor, which can make use of one or more cryptographic algorithm electronic logic, which can include encryption code, and/or a cryptographic combiner, etc., and may be stored in encrypted form, according to an exemplary embodiment, in a computer database storage facility, from computer database storage device, and from there the process can continue with use of the cryptographic algorithm electronic logic, and electronic decryptor, which can decrypt and/or provide a process for decrypting encrypted data, and/or by providing such data to the DSS, the DBMS, or the EIGUI, if authorized (not shown). By using encryption/decryption, certain algorithms can be used, as described above, including, e.g., but not limited to, AES encryption, RSA, PKI, TLS, FTPS, SFTP, etc. and/or other cryptographic algorithms and/or protocols. The system may include various encryption and decryption subsystems including, e.g., but not limited to some of the following technologies. Certain data, including, e.g., password, personal identification information (PII), sensitive information, and the like, especially in a world of largescale AI based analysis, to ensure access is restricted from systems which might otherwise be vulnerable to disclosure and/or unintended publication and/or release, may be best encrypted via cryptographic algorithms and functions.

Cryptographic Functions

Cryptographic systems, according to an exemplary embodiment, can provide one or more of the following four example services (a) authentication, (b) nonrepudiation, (c) confidentiality, and (d) integrity). It is important to distinguish between these, as some algorithms are more suited to particular tasks, but not to others. To protect patient data, personal data can be encrypted prior to storage and can be decrypted before accessing the data, according to an exemplary embodiment. When analyzing requirements and risks, one needs to decide which of the four functions should be used to protect the proprietary data, according to an exemplary embodiment.

Authentication

Using a cryptographic system, according to an exemplary embodiment, one can establish the identity of a remote user (or system). A typical example is the SSL certificate of a web server providing proof to the user device that user device is connected to the correct server, according to an exemplary embodiment.

The identity is not of the user, but of the cryptographic key of the user. Having a less secure key lowers the trust one can place on the identity, according to an exemplary embodiment.

Non-Repudiation

The concept of non-repudiation is particularly important for financial or e-commerce applications, according to an exemplary embodiment. Often, cryptographic tools are required to prove that a unique user has made a transaction request, according to an exemplary embodiment. It must not be possible for the user to refute his or her actions, according to an exemplary embodiment.

For example, a customer can request a transfer of money from her account to be paid to another account, according to an exemplary embodiment. Later, she claims never to have made the request and demands the money be refunded to the account. If one has non-repudiation through cryptography, one can prove—usually through digitally signing the transaction request, that the user authorized the transaction.

Confidentiality

More commonly, the biggest concern can be to keep information private, according to an exemplary embodiment. Cryptographic systems, according to an exemplary embodiment, have been developed to function in this capacity. Whether it be passwords sent during a log on process, or storing confidential proprietary financial data in a database, encryption can assure that only users who have access to the appropriate key can get access to the proprietary data.

Integrity

One can use cryptography, according to an exemplary embodiment, to provide a means to ensure data is not viewed or altered during storage or transmission. Cryptographic hashes for example, can safeguard data by providing a secure checksum, according to an exemplary embodiment.

Cryptographic Algorithms

Various types of cryptographic systems exist that have different strengths and weaknesses, according to an exemplary embodiment. Typically, the exemplary cryptographic systems can be divided into two classes; 1) those that are strong, but slow to run, and 2) those that are quick, but less secure. Most often a combination of the two approaches can be used, according to an exemplary embodiment (e.g.: secure socket layer (SSL)), whereby we establish the connection with a secure algorithm, and then if successful, encrypt the actual transmission with the weaker, but much faster algorithm.

Symmetric Cryptography

Symmetric Cryptography, according to an exemplary embodiment, is the most traditional form of cryptography. In a symmetric cryptosystem, the involved parties share a common secret (password, pass phrase, or key), according to an exemplary embodiment. Data can be encrypted and decrypted using the same key, according to an exemplary embodiment. These symmetric cryptography algorithms tend to be comparatively fast, but the algorithms cannot be used unless the involved parties have already exchanged keys, according to an exemplary embodiment. Any party possessing a specific key can create encrypted messages using that key as well as decrypt any messages encrypted with the key, according to an exemplary embodiment. In systems involving a number of users who each need to set up independent, secure communication channels, symmetric cryptosystems can have practical limitations due to the requirement to securely distribute and manage large numbers of keys, according to an exemplary embodiment.

Common examples of symmetric algorithms include, e.g., but not limited to, DES, 3DES and/or AES, etc. The 56-bit keys used in DES are short enough to be easily brute-forced by modern hardware and DES should no longer be used, according to an exemplary embodiment. Triple DES (or 3DES) uses the same algorithm, applied three times with different keys giving it an effective key length of 128 bits, according to an exemplary embodiment. Due to the problems using the DES algorithm, the United States National Institute of Standards and Technology (NIST) hosted a selection process for a new algorithm. The winning algorithm was Rijndael and the associated cryptosystem is now known as the Advanced Encryption Standard or AES, according to an exemplary embodiment. For most applications 3DES, according to an exemplary embodiment, is acceptably secure at the current time, but for most new applications it is advisable to use AES, according to an exemplary embodiment.

Asymmetric Cryptography (Also Called Public/Private Key Cryptography)

Asymmetric algorithms, according to an exemplary embodiment, use two keys, one to encrypt the data, and either key to decrypt. These inter-dependent keys are generated together, according to an exemplary embodiment. One key is labeled the Public key and is distributed freely, according to an exemplary embodiment. The other key is labeled the Private Key and must be kept hidden, according to an exemplary embodiment. Often referred to as Public/Private Key Cryptography, these cryptosystems can provide a number of different functions depending on how they are used, according to an exemplary embodiment.

The most common usage of asymmetric cryptography is to send messages with a guarantee of confidentiality, according to an exemplary embodiment. If User A wanted to send a message to User B, User A would get access to User B's publicly available Public Key, according to an exemplary embodiment. The message is then encrypted with this key and sent to User B, according to an exemplary embodiment. Because of the cryptosystem's property that messages encoded with the Public Key of User B can only be decrypted with User B's Private Key, only User B can read the message, according to an exemplary embodiment.

Another usage scenario is one where User A wants to send User B a message and wants User B to have a guarantee that the message was sent by User A, according to an exemplary embodiment. In order to accomplish this, User A can encrypt the message with their Private Key, according to an exemplary embodiment. The message can then only be decrypted using User A's Public Key, according to an exemplary embodiment. This can guarantee that User A created the message because User A is then the only entity who had access to the Private Key required to create a message that can be decrypted by User A's Public Key, according to an exemplary embodiment. This is essentially a digital signature guaranteeing that the message was created by User A, according to an exemplary embodiment.

A Certificate Authority (CA), whose public certificates are installed with browsers or otherwise commonly available, may also digitally sign public keys or certificates, according to an exemplary embodiment. One can authenticate remote systems or users via a mutual trust of an issuing CA, according to an exemplary embodiment. One can trust their 'root' certificates, according to an exemplary embodiment, which in turn authenticates the public certificate presented by the server.

PGP and SSL are prime examples of systems implementing asymmetric cryptography, using RSA and/or other algorithms, according to an exemplary embodiment.

Hashes

Hash functions, according to an exemplary embodiment, take some data of an arbitrary length (and possibly a key or password) and generate a fixed-length hash based on this input. Hash functions used in cryptography have the property that it can be easy to calculate the hash, but difficult or impossible to re-generate the original input if only the hash value is known, according to an exemplary embodiment. In addition, hash functions useful for cryptography have the property that it is difficult to craft an initial input such that the hash will match a specific desired value, according to an exemplary embodiment.

MD5 and SHA-1 are common hashing algorithms, according to an exemplary embodiment. These algorithms are considered weak and are likely to be replaced in due time after a process similar to the AES selection, according to an exemplary embodiment. New applications should consider using SHA-256 instead of these weaker algorithms, according to an exemplary embodiment.

Key Exchange Algorithms

There are also key exchange algorithms (such as Diffie-Hellman for SSL), according to an exemplary embodiment. These key exchange algorithms can allow use to safely exchange encryption keys with an unknown party, according to an exemplary embodiment.

Algorithm Selection

As modern cryptography relies on being computationally expensive to break, according to an exemplary embodiment, specific standards can be set for key sizes that can provide assurance that with today's technology and understanding, it will take too long to decrypt a message by attempting all possible keys, according to an exemplary embodiment.

Therefore, we need to ensure that both the algorithm and the key size are taken into account when selecting an algorithm, according to an exemplary embodiment.

Uses of conjunction language such as the word or, and/or, and, and the like, are intended herein to include the logical or interpretation, rather than an exclusive or interpretation. Thus, any use of or, can mean either alternative individually, and/or both alternatives. Further, where a plurality of alternatives are listed, any one or more of the alternatives can be considered, thus if a list of five alternatives are listed, any one or more, or combinations of any of the five alternatives, including all five alternatives, can also be considered within the scope of protection.

All examples, usage of example embodiments, exemplary embodiments, and the like, etc., and conditional language recited herein are intended for pedagogical purposes to aid the reader in understanding the principles of the disclosure and the concepts contributed by the inventor to furthering the art, and are to be construed as being without limitation to such specifically recited examples and conditions, and are merely illustrative, nonlimiting, and should not limit the claimed inventions in any way. Moreover, all statements herein reciting principles, aspects, objects, etc., and embodiments, as well as specific examples thereof, are intended to encompass both structural and functional equivalents thereof. Functional names are not intended to trigger any section of the statute, and embodiment embodiments which perform equivalent functions, way and result, not merely equivalents of disclosed electro-mechanical elements. Additionally, it is intended that such equivalents include both currently known equivalents as well as equivalents developed in the future, i.e., any elements developed that perform the same function, in similar way, to achieve similar results, regardless of structure.

FIG. 5 as noted above, depicts an example embodiment of a computer system including example diagram 500, as may be used, e.g., but not limited to, for computer device 404, or other computer systems as discussed herein, in various example embodiments.

Figure 6:
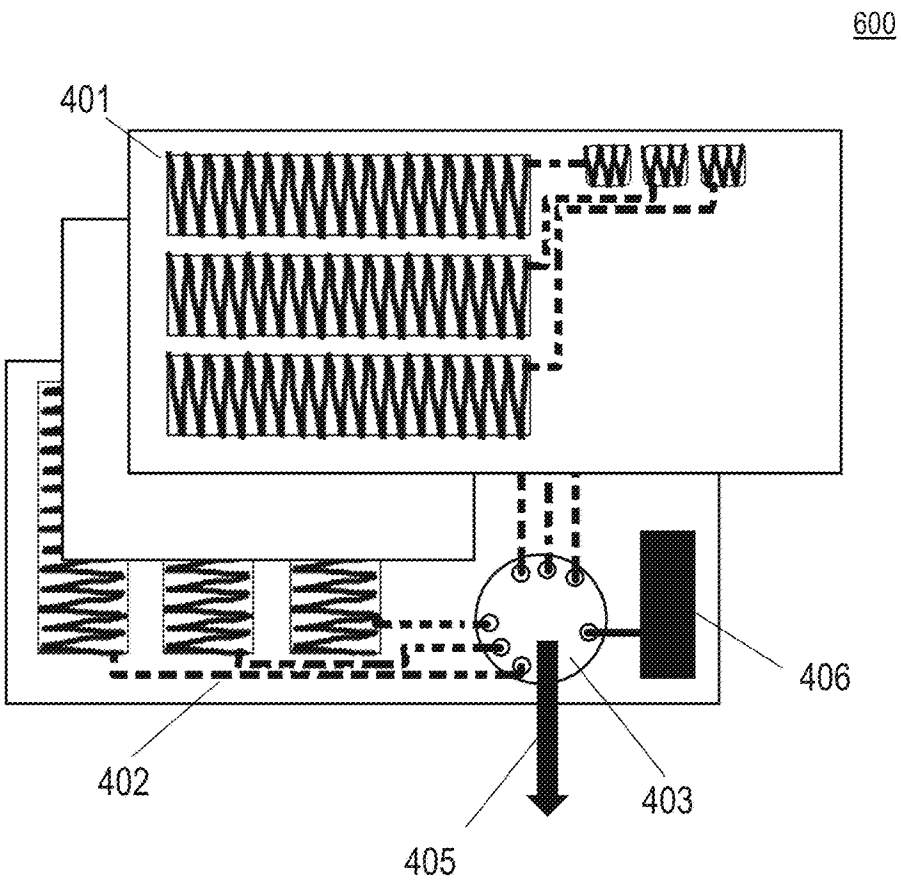
FIG. 6 depicts an example embodiment illustrating other example components of an example computer system and sensing device, according to an example embodiment.
Figure 6:
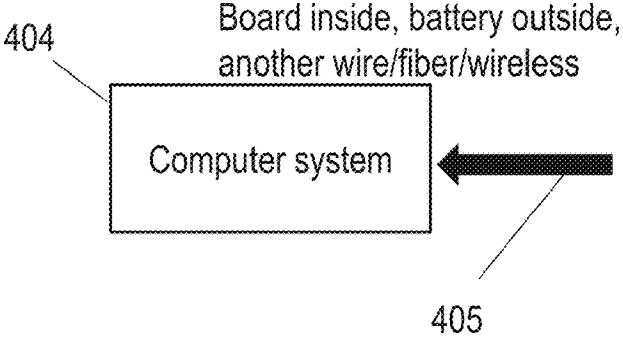

FIG. 6 depicts an example embodiment of example diagram 600, illustrating other example components of an example computer system and sensing device, according to an example embodiment.

Figure 7:
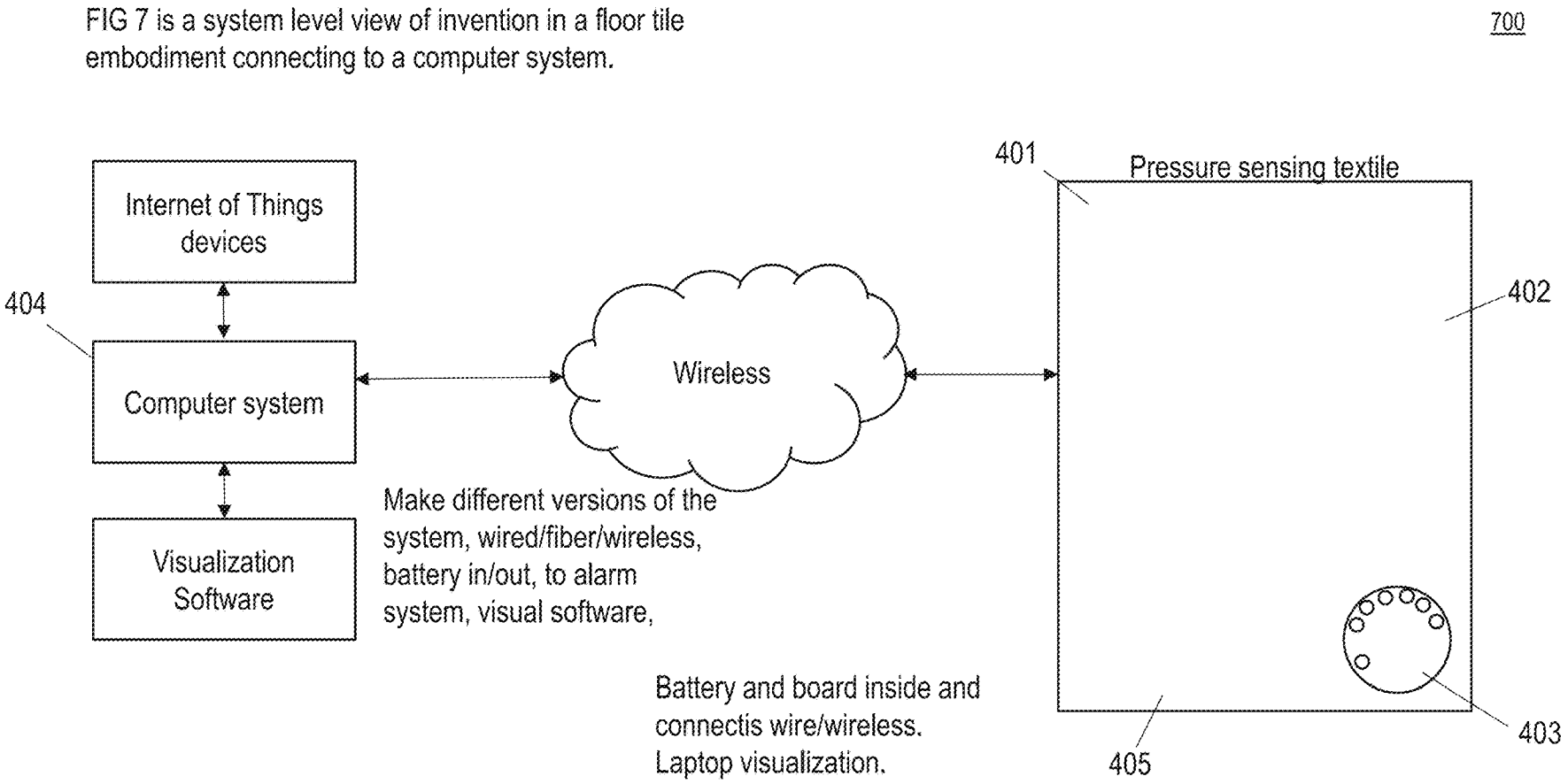
FIG. 7 depicts an example embodiment illustrating other example components of an example computer system, IoT system, and Visualization software system (optional), and sensing device, with example wireless communication system for coupling, according to an example embodiment.

FIG. 7 depicts an example embodiment of example diagram 700, illustrating other example components of an example computer system, IoT system, and Visualization software system (optional), and sensing device, with example wireless communication system for coupling, according to an example embodiment.

Figure 8:
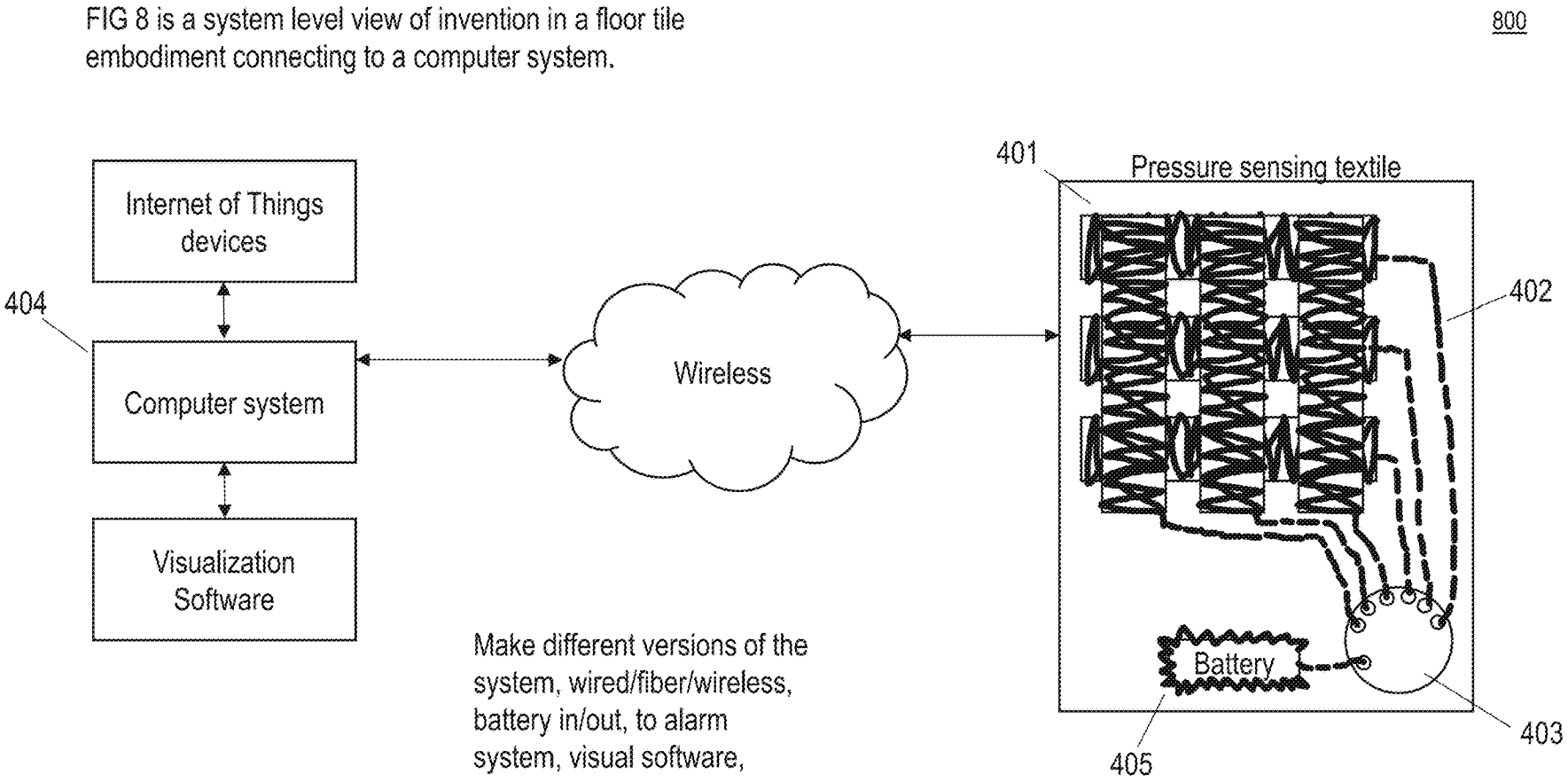
FIG. 8 depicts an example embodiment illustrating other example components of an example computer system, IoT system, and Visualization software system (optional), and sensing device, with example wireless communication system for coupling, according to an example embodiment.

FIG. 8 depicts an example embodiment of example diagram 800, illustrating other example components of an example computer system, IoT system, and Visualization software system (optional), and sensing device, with example wireless communication system for coupling, according to an example embodiment.

Figure 9:
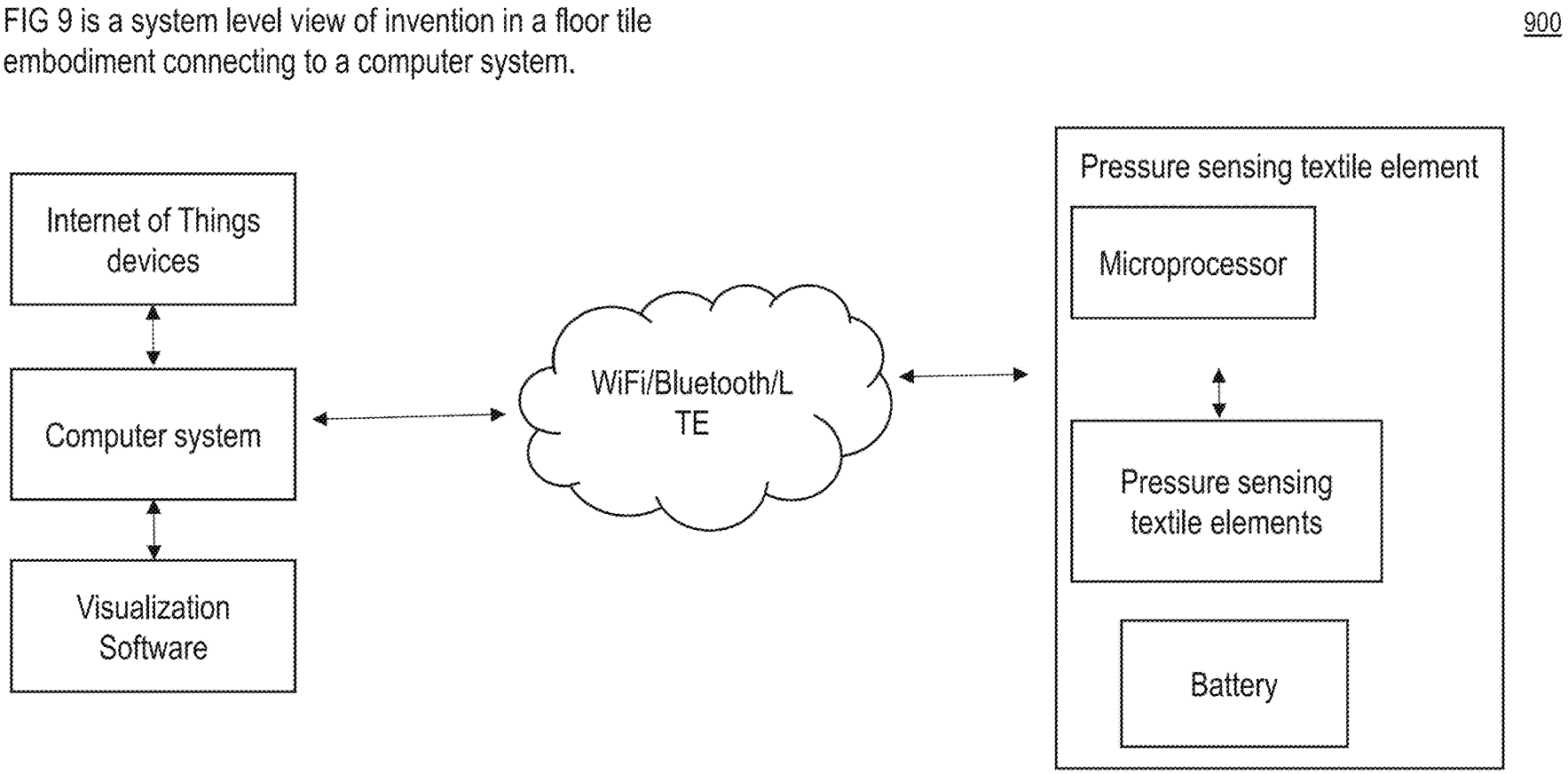
FIG. 9 depicts an example embodiment illustrating other example components of an example computer system and sensing device example floor tile embodiment, according to an example embodiment.

FIG. 9 depicts an example embodiment of example diagram 900, illustrating other example components of an example computer system and sensing device example floor tile embodiment, according to an example embodiment.

Figure 10:
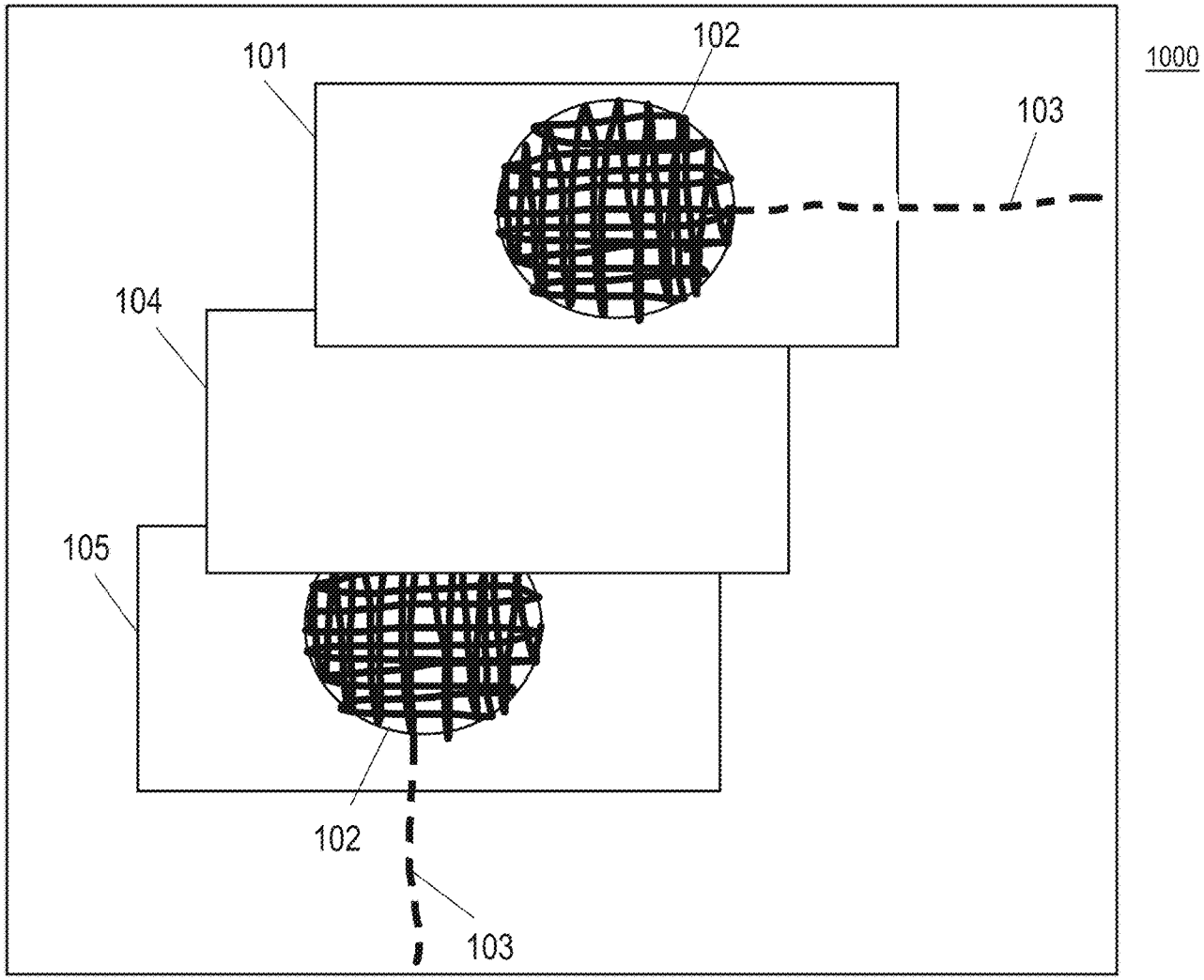
FIG. 10 depicts an example embodiment illustrating other example components of an example three layer sensing device, according to an example embodiment.

FIG. 10 depicts an example embodiment of example diagram 1000, illustrating other example components of an example three layer sensing device, according to an example embodiment.

Figure 11:
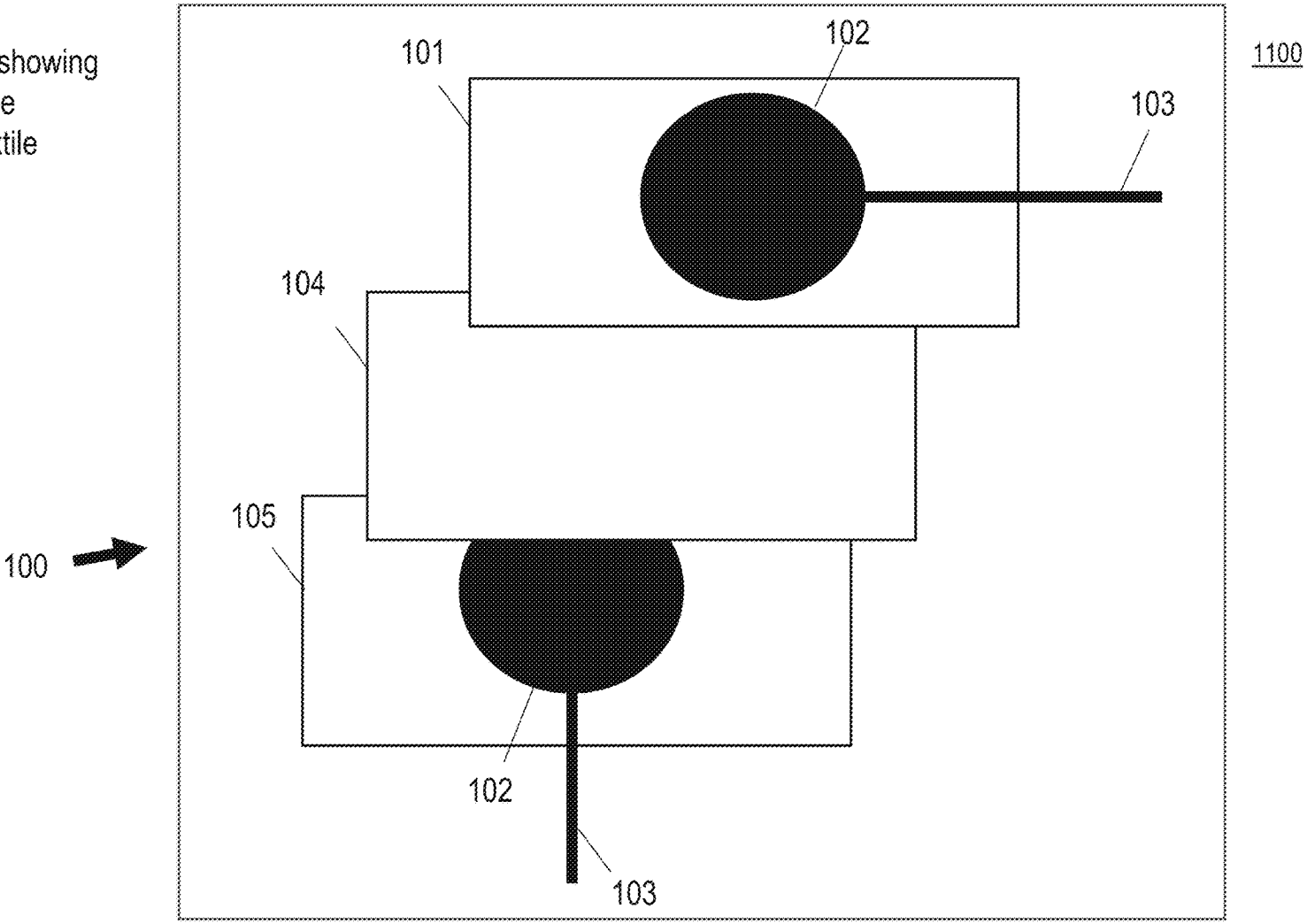
FIG. 11 depicts another example embodiment illustrating other example components of an example three layer sensing device, according to an example embodiment.

FIG. 11 depicts another example embodiment of example diagram 1100, illustrating other example components of an example three layer sensing device, according to an example embodiment.

Figure 12:
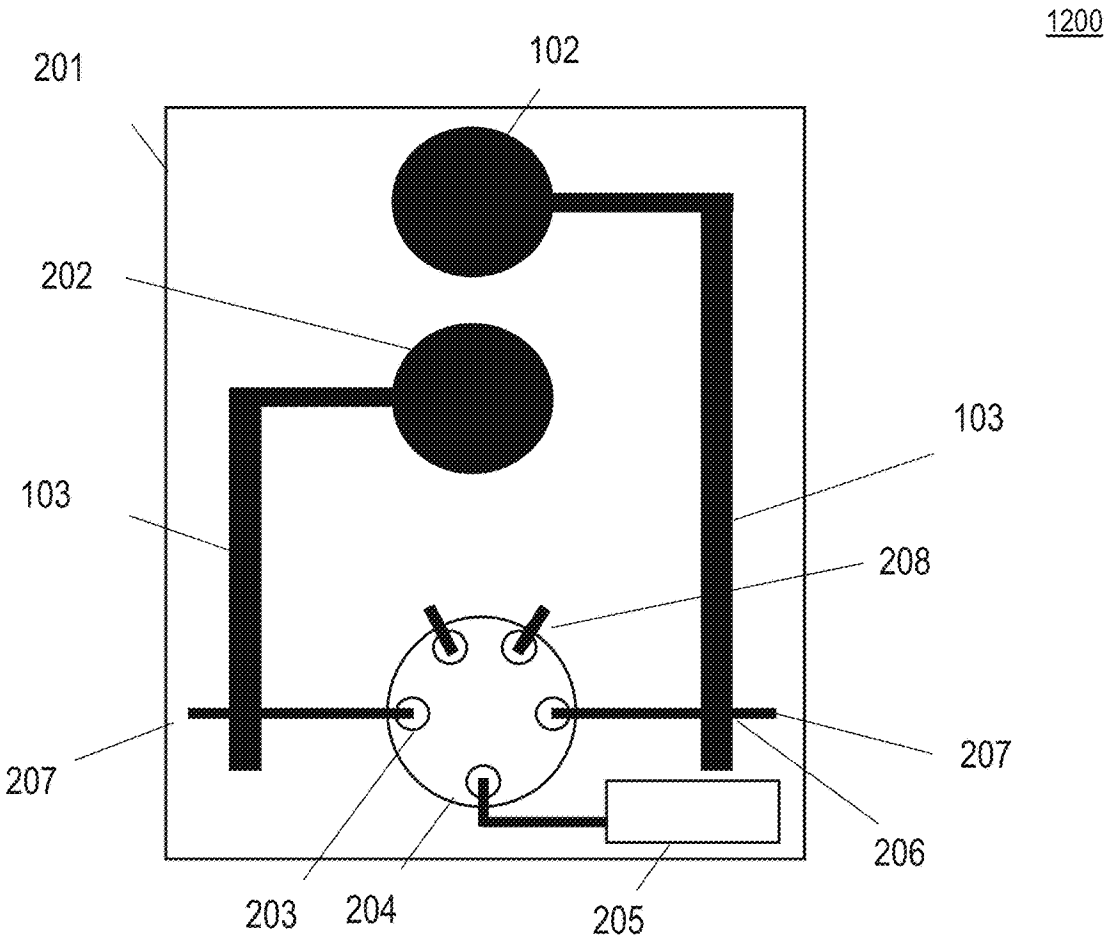
FIG. 12 depicts another example embodiment illustrating an example detailed view of other example components of an example sensing device and example coupling to an example microprocessor, according to an example embodiment.

FIG. 12 depicts another example embodiment of example diagram 1200, illustrating an example detailed view of other example components of an example sensing device and example coupling to an example microprocessor, according to an example embodiment.

Figure 13:
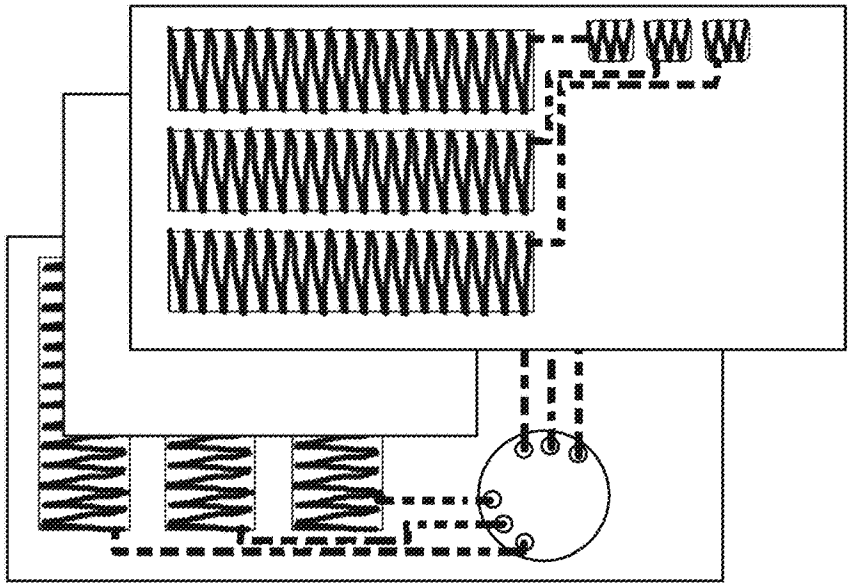
FIG. 13 depicts another example embodiment illustrating an example detailed view of example grid view rows and columns components of an example sensing device and example coupling to an example microprocessor, according to an example embodiment.

FIG. 13 depicts another example embodiment of example diagram 1300, illustrating an example detailed view of example grid view rows and columns components of an example sensing device and example coupling to an example microprocessor, according to an example embodiment.

Figure 14:
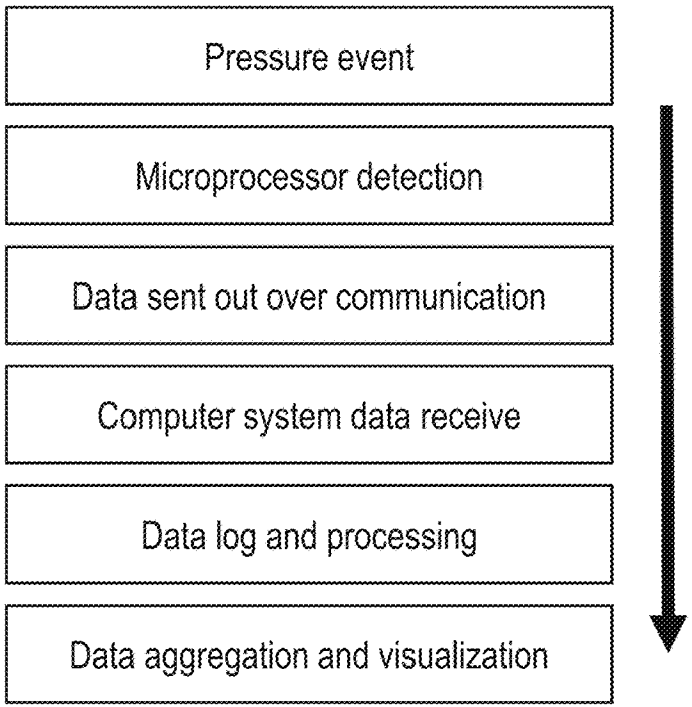
FIG. 14 depicts an example embodiment illustrating an example processing data flow flow chart diagram, according to an example embodiment.

FIG. 14 depicts an example embodiment of example diagram 1400, illustrating an example processing data flow flow chart diagram, according to an example embodiment.

Figure 15:
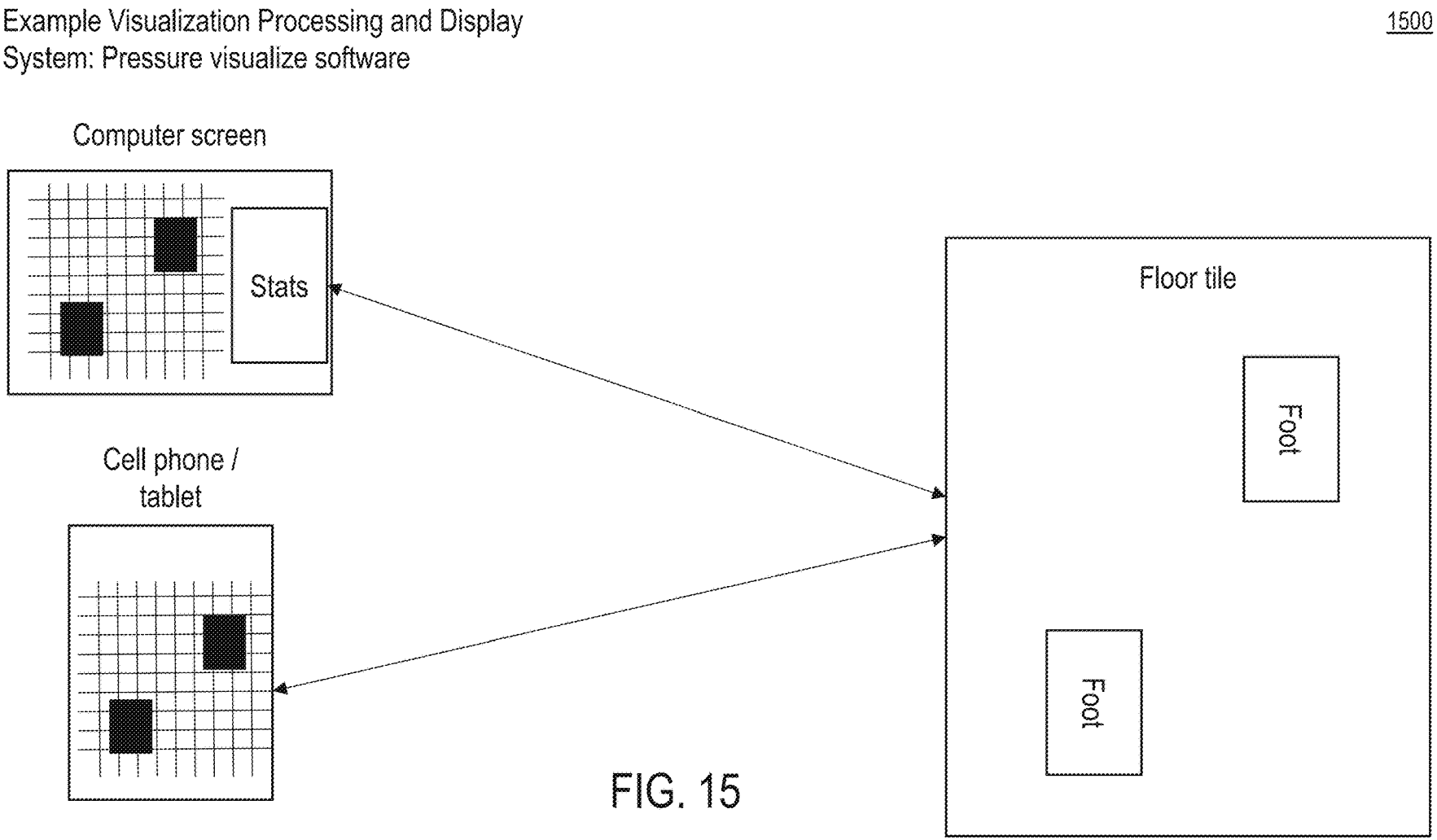
FIG. 15 depicts an example embodiment illustrating an example visualization processing and display, and example screen display depictions of analyzed sensed data, according to an example embodiment.

FIG. 15 depicts an example embodiment of example diagram 1500, illustrating an example visualization processing and display, and example screen display depictions of analyzed sensed data, according to an example embodiment.

Figure 16:
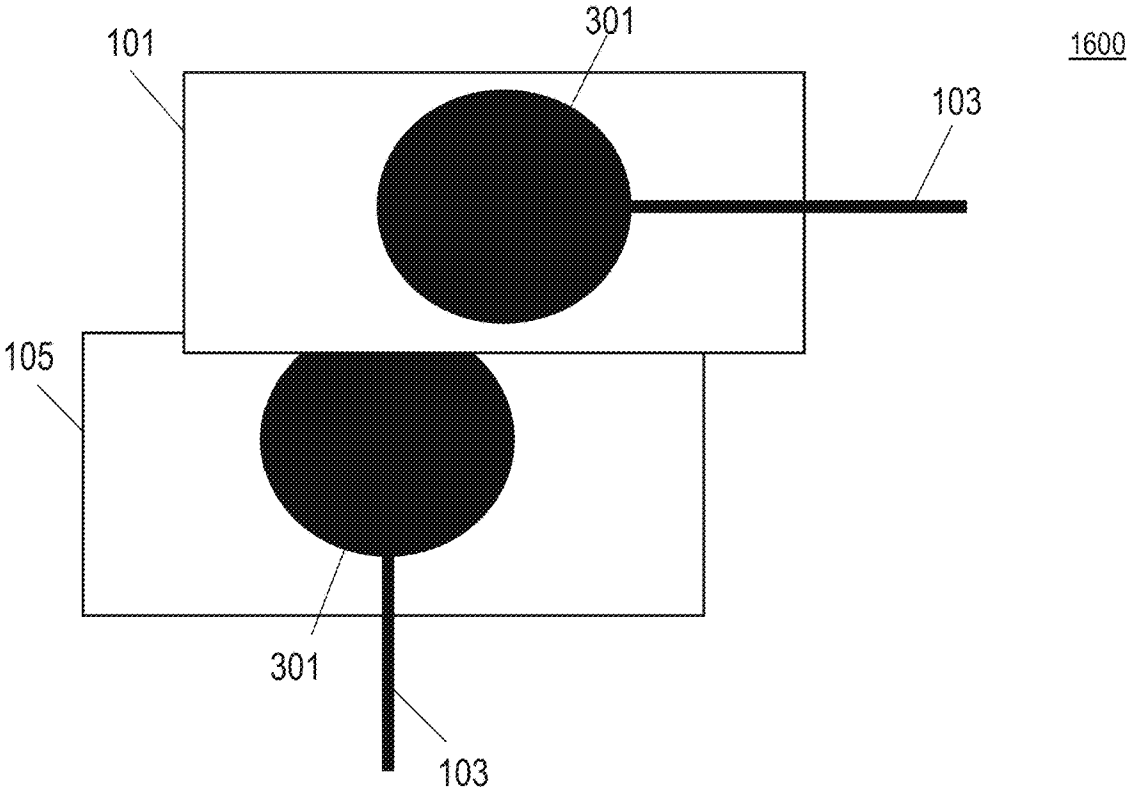
FIG. 16 depicts an example embodiment illustrating an example two pad sensing system, according to an example embodiment.

FIG. 16 depicts an example embodiment of example diagram 1600, illustrating an example two pad sensing system, according to an example embodiment.

Figure 17:
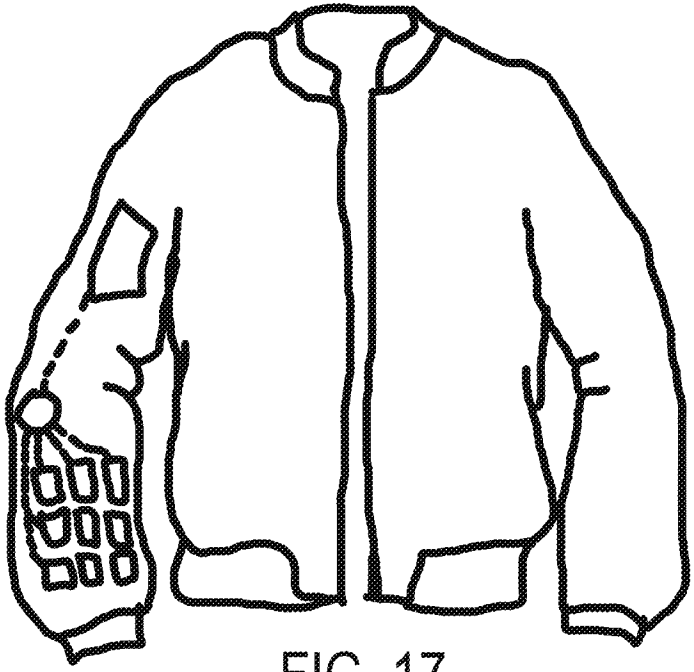
FIG. 17 depicts an example embodiment illustrating an example wearable jacket with integrated sensing system, according to an example embodiment.

FIG. 17 depicts an example embodiment of example diagram 1700, illustrating an example wearable jacket with integrated sensing system, according to an example embodiment.

Figure 18:
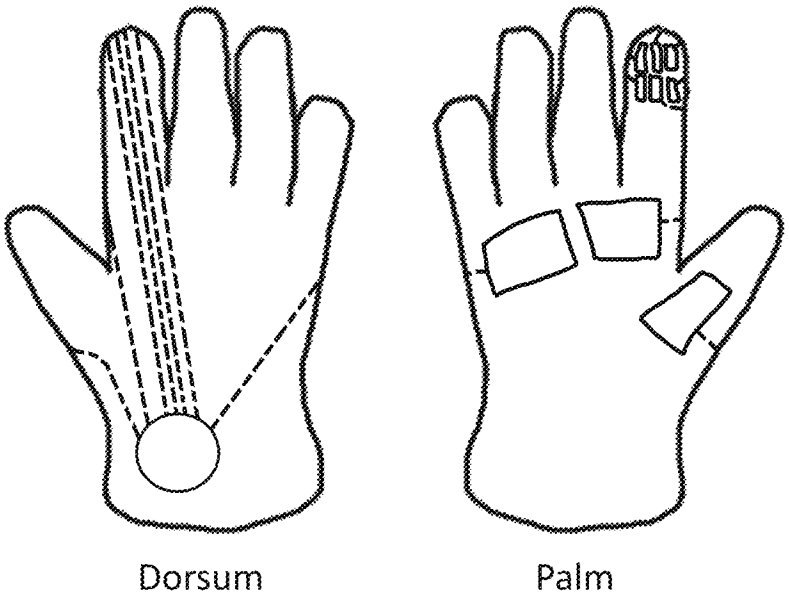
FIG. 18 depicts an example embodiment illustrating an example wearable glove with integrated sensing system, according to an example embodiment.
Figure 19:
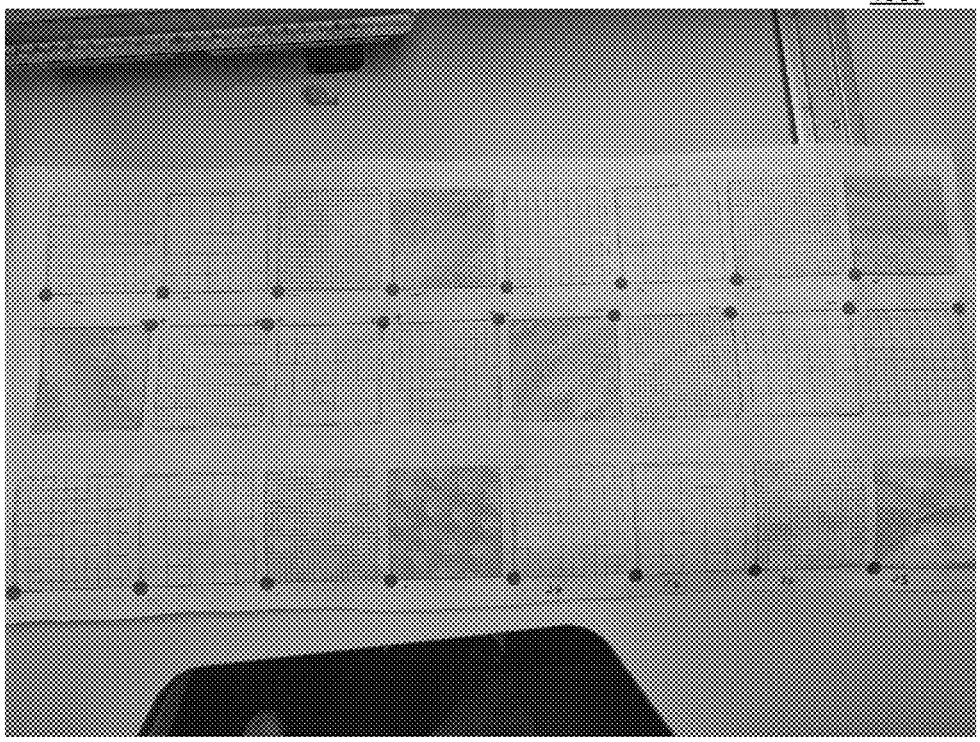
FIGS. 19, 20, 21, 22, 23, 24, 25, 26, 27, 28, 29, and 30 depict illustrative images of example protypes of various example layers as may be used to construct an example device according to example embodiments, including various sub-components, and examples of assembled embroidered devices, according to an example embodiment.
Figure 20:
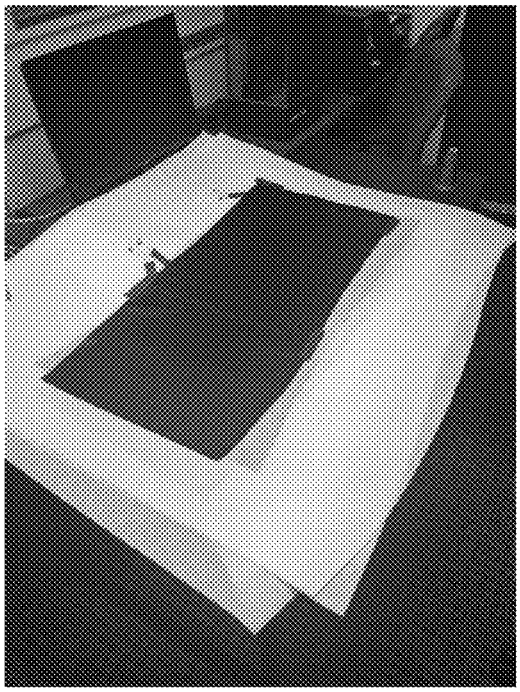
Figure 21:
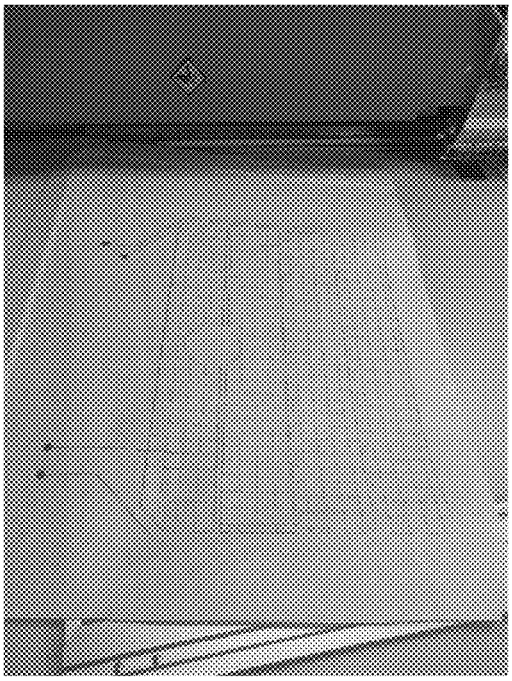
Figure 22:
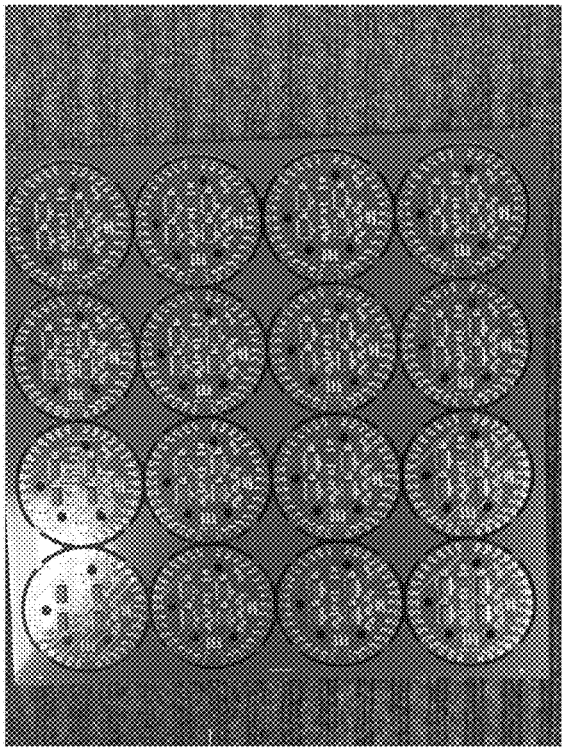
Figure 23:
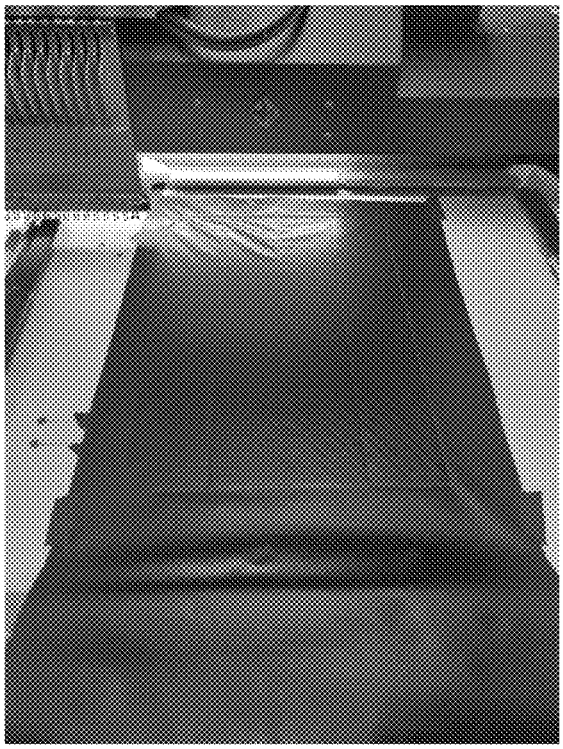
Figure 24:
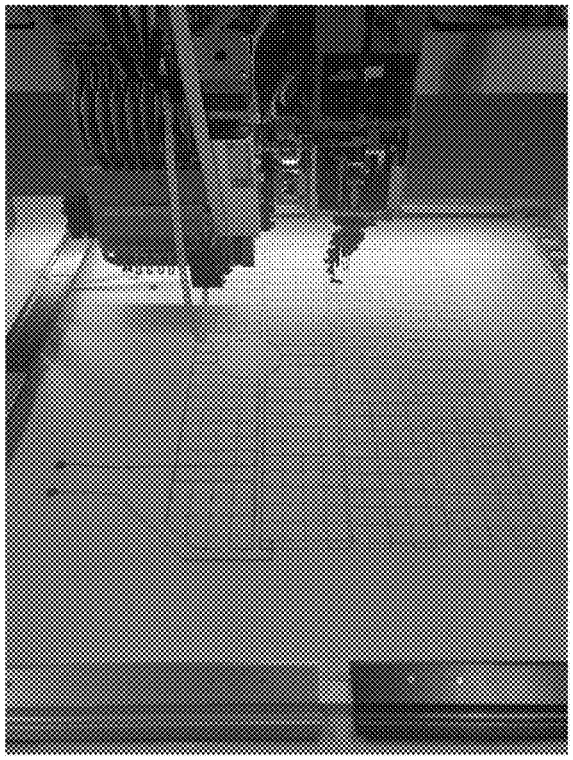
Figure 25:
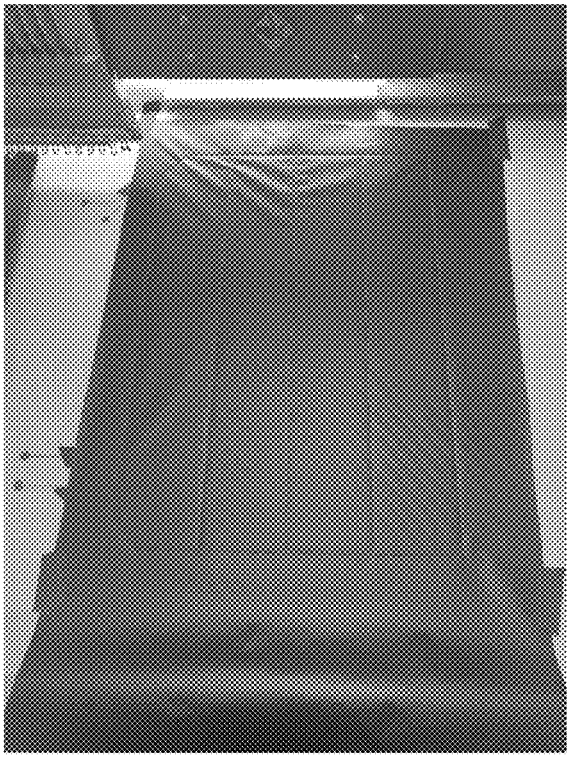
Figure 26:
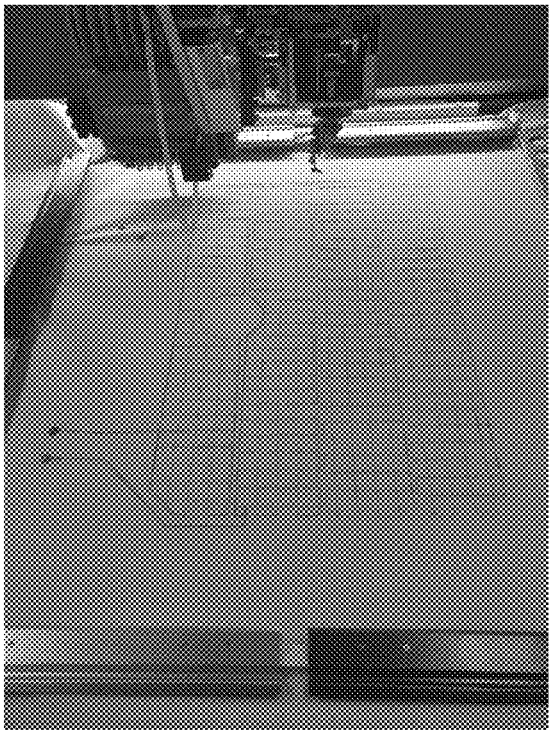
Figure 27:
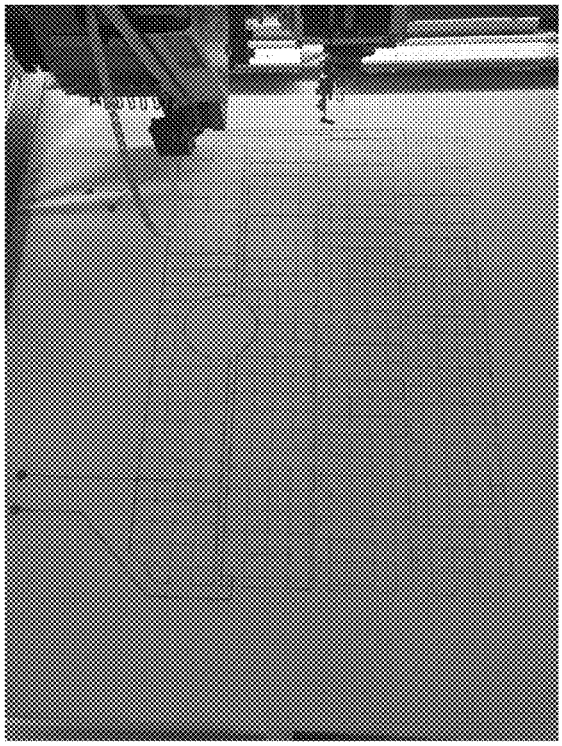
Figure 28:
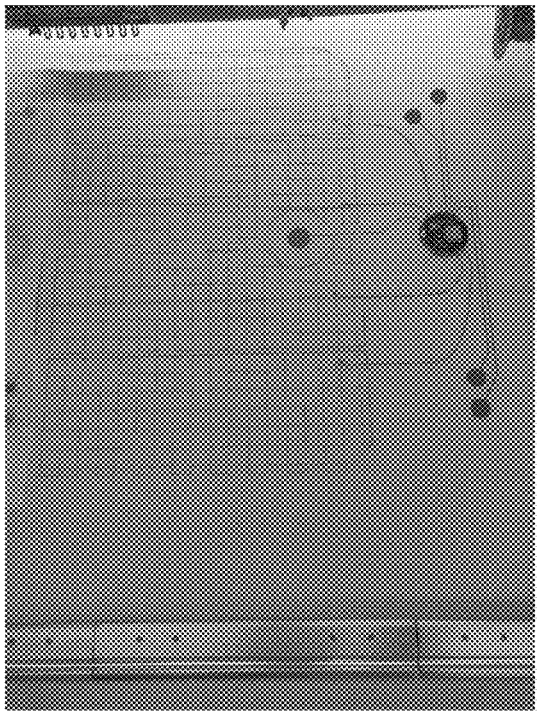
Figure 29:
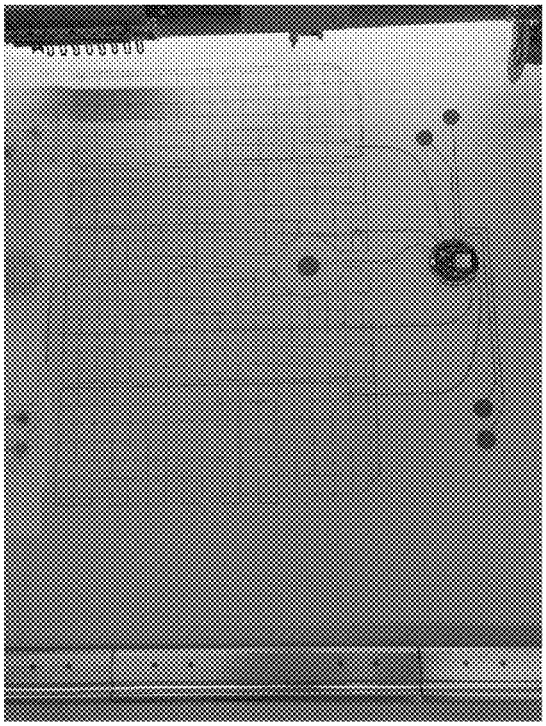
Figure 30:
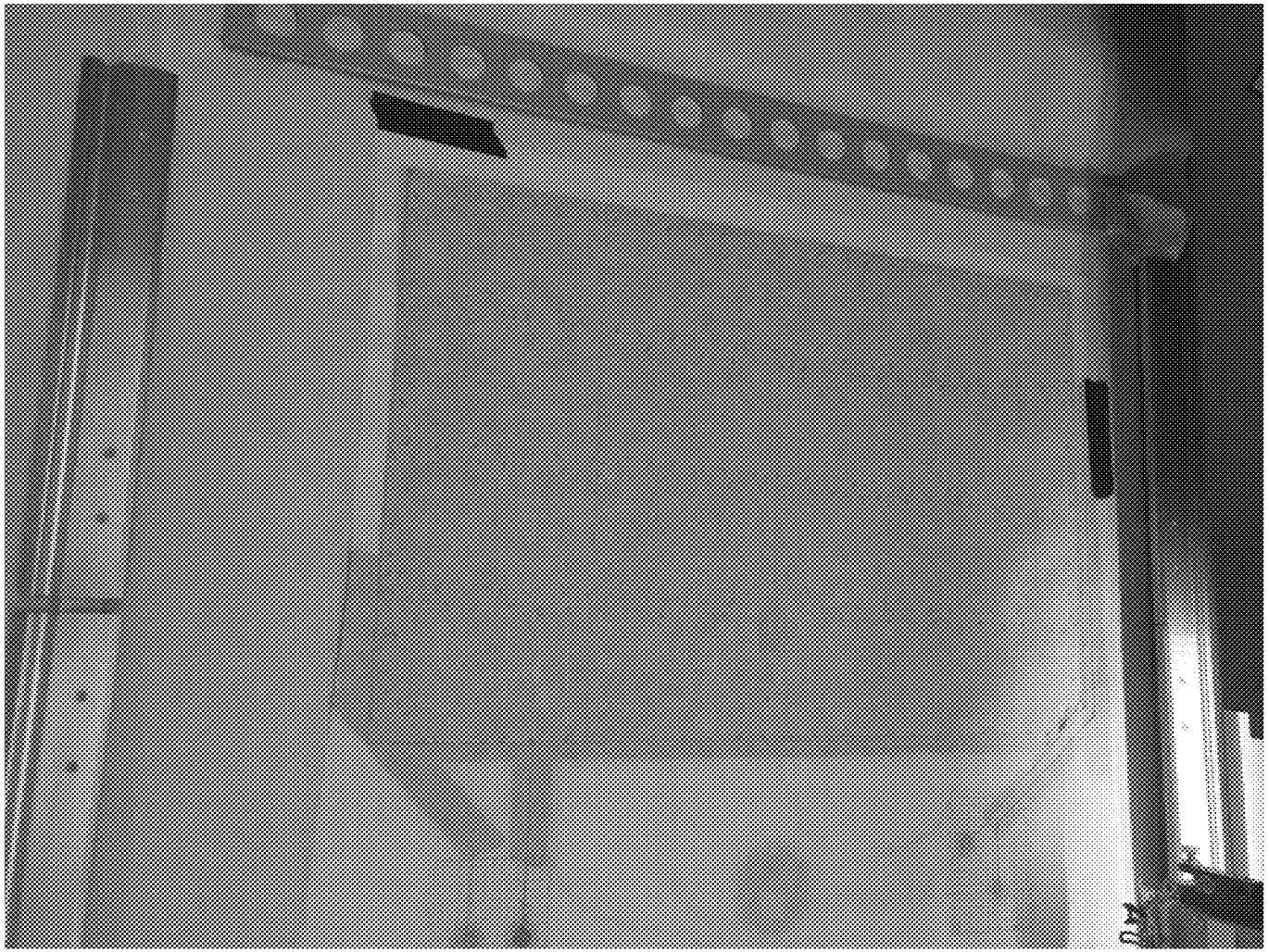

FIG. 18 depicts an example embodiment of example diagram 1800, illustrating an example wearable glove with integrated sensing system, according to an example embodiment.

FIGS. 19, 20, 21, 22, 23, 24, 25, 26, 27, 28, 29, and 30 depict various example diagrams 1900, 2000, 2100, 2200, 2300, 2400, 2500, 2600, 2700, 2800, 2900, 3000, respectively, of illustrative images of example protypes of various example layers as may be used to construct an example device according to example embodiments, including various sub-components, and examples of assembled embroidered devices, according to an example embodiment.

While various embodiments of the present invention have been described above, it should be understood that they have been presented by way of example only, and not limitation. Thus, the breadth and scope of the present invention should not be limited by any of the above-described exemplary embodiments, but should instead be defined only in accordance with the following claims and their equivalents. Although the invention is described in terms of the exemplary embodiments, it is important to note that the description in these terms is provided for purposes of illustration only. It is not intended that the invention be limited to these example environments or to the precise interaction between the different elements of the invention. In fact, after reading the following descriptions it will become apparent to a person skilled in the art how to implement the invention in alternative environments.

What is claimed is:

1. A pressure sensing textile comprising:

a first layer comprising fabric, said first layer comprising fabric being embroidered with a first at least one conductive thread, and a second layer comprising a pressure sensitive conductive sheet, and wherein the pressure sensing textile comprises at least one or more of:

a second at least one conductive thread wherein said second at least one conductive thread is embroidered onto at least one of:

the first layer, and the second layer; or a third layer comprising fabric, said third layer being embroidered with a second at least one conductive thread, wherein said first layer and said third layer comprise fabric of a different type of material.

2. The pressure sensing textile of claim 1 wherein at least two of:

said first layer, said second layer, and said third layer are sewn together such that said first at least one conductive thread of said first layer is positioned to align with said second at least one conductive thread at at least one location.

3. The pressure sensing textile of claim 1 wherein at least one of:

said first at least one conductive thread, or said second at least one conductive thread is sewn into the pressure sensing textile to create at least one or more of:

at least one electrically conductive path between said first conductive layer and said second conductive layer, or at least one electrical connection or coupling to at least one or more of:

at least one wire, at least one circuit board, or at least one electrical component.

4. The pressure sensing textile of claim 1, further comprising:

at least one electronic module, said at least one electronic module operable to measure electrical conductivity of said second layer comprising said pressure sensitive conductive sheet at at least one location.

5. The pressure sensing textile of claim 4, wherein said electronic module being operable to measure the electronical conductivity to obtain measurement information is further operable to at least one or more of:

electronically and automatically store said measurement information;

electronically transmit said measurement information over at least one wireless connection or coupling;

electronically transmit said measurement information over at least one wired connection or coupling;

electronically transmit said measurement information over at least one fiber connection or coupling; or electronically perform an action based on said measurement information.

6. The pressure sensing textile of claim 4, wherein said at least one electronic module is sewn into the pressure sensing textile.

7. The pressure sensing textile of claim 4 wherein said at least one electronic module electrically connects or couples to said first at least one conductive thread of said first layer and electrically connects or couples to said second at least one conductive thread.

8. The pressure sensing textile of claim 4 wherein said at least one electronic module is protected by a hard shell, said hard shell being sewn onto the pressure sensing textile.

9. The pressure sensing textile of claim 8 wherein said first layer and another layer comprise the seme type of material.

10. The pressure sensing textile of claim 4 wherein said at least one electronic module is external to said textile and electrically connects or couples to said first at least one conductive thread of said first layer and electrically connects or couples to said second at least one conductive thread.

11. A system comprising:
at least one electronic computer comprising:
at least one electronic computer processor, and
at least one electronic memory electronically coupled to said at least one electronic computer processor,
said at least one electronic computer processor configured to connect or couple to at least one electronic module of a pressure sensing textile by at least one or more of:
a wireless connection or coupling;
a wired connection or coupling;
an optical connection or coupling; or
a fiber connection or coupling; and
wherein the pressure sensing textile comprises:
a first layer comprising fabric, said first layer comprising fabric being embroidered with a first at least one conductive thread, and
a second layer comprising a pressure sensitive conductive sheet, and
wherein the pressure sensing textile comprises at least one or more of:
a second at least one conductive thread wherein said second at least one conductive thread is embroidered onto at least one of:
the first layer, and
the second layer, or
a third layer comprising fabric, said third layer being embroidered with a second at least one conductive thread, wherein said first layer and said third layer comprise fabric of a different type of material; and
wherein the at least one electronic module is operable to measure electrical conductivity to obtain measurement information of said second layer comprising said pressure sensitive conductive sheet at at least one location.

12. The pressure sensing textile of claim 4 further comprising:
wherein said at least one electronic module comprises at least one wired connection or coupling to at least one or more of:
an alarm system;
an optical sensor;
an external electrical sensor input;
an electronic sensor;
an electro-mechanical sensor;
an external sensor;
a sensor;
an external passive sensor;
a passive sensor; or
an external passive sensor input.

13. The system according to claim 11, wherein said at least one electronic computer processor is operable to receive said measurement information from said at least one electronics module operable to at least one or more of:
electronically store said measurement information;
electronically process said measurement information;
electronically display said measurement information; or
electronically perform an action based on receipt of said measurement information.

14. The system according to claim 11, wherein said at least one electronic computer further comprises a wired connection or coupling to at least one or more of:
an alarm system;
an optical sensor;
an external electrical sensor input;
an electronic sensor;
an electro-mechanical sensor;
an external sensor;
a sensor;
an external passive sensor;
a passive sensor; or
an external passive sensor input.

15. The pressure sensing textile of claim 1 further comprising:
at least one additional layer of material to provide at least one or more of:
environmental protection;
mechanical protection;
radiation protection;
temperature measurement;
temperature insulation;
signal measurement;
signal monitoring;
sound measurement;
vibration signal measurement;
sleep monitoring and analysis;
heart signal measurement or monitoring;
durability;
padding;
non-slip;
waterproofing;
separation of layers;
comfort;
camouflage;
decoration; or
sound insulation.

16. A computer program product embodied on at least one nontransitory computer accessible storage medium comprising at least one instruction, which when executed on at least one electronic computer processor, performs a method of:
electronically connecting or electronically coupling to at least one electronic module of a pressure sensing textile by at least one or more of:
a wireless connection or coupling;
a wired connection or coupling;
an optical connection or coupling; or
a fiber connection or coupling; and
wherein the pressure sensing textile comprises:
a first layer comprising fabric, said first layer comprising fabric being embroidered with a first at least one conductive thread, and
a second layer comprising a pressure sensitive conductive sheet, and
wherein the pressure sensing textile comprises at least one or more of:
a second at least one conductive thread wherein said second at least one conductive thread is embroidered onto at least one of:
the first layer, and
the second layer, or
a third layer comprising fabric, said third layer being embroidered with a second at least one conductive thread, wherein said first layer and said third layer comprise fabric of a different type of material; and wherein the at least one electronic module is operable to measure electrical conductivity to obtain measurement information of said second layer comprising said pressure sensitive conductive sheet at at least one location.

17. The computer program product according to claim 16, wherein the method further comprises:

receiving the measurement information from said at least one electronics module, and at least one or more of:

electronically storing said measurement information;

electronically processing said measurement information;

electronically displaying said measurement information; or electronically performing an action based on receipt of said measurement information.

* * * * *